US012685339B2

(12) United States Patent
Butin et al.

(10) Patent No.: US 12,685,339 B2
(45) Date of Patent: Jul. 21, 2026

(54) AEROSOL-GENERATING DEVICE AND SYSTEM COMPRISING AN INDUCTIVE HEATING DEVICE AND METHOD OF OPERATING THE SAME

(71) Applicant: Philip Morris Products S.A., Neuchatel (CH)

(72) Inventors: Yannick Butin, Marin-Epagnier (CH); Lucas Gattoni, Morges (CH); Farhang Mohseni, Neuchatel (CH); Milica Nesovic, Neuchatel (CH); Enrico Stura, Palezieux-Village (CH)

(73) Assignee: Philip Morris Products S.A., Neuchatel (CH)

( * ) Notice: Subject to any disclaimer, the term of this patent is extended or adjusted under 35 U.S.C. 154(b) by 285 days.

(21) Appl. No.: 18/258,240

(22) PCT Filed: Dec. 23, 2021

(86) PCT No.: PCT/EP2021/087545
§ 371 (c)(1),
(2) Date: Jun. 19, 2023

(87) PCT Pub. No.: WO2022/136661
PCT Pub. Date: Jun. 30, 2022

(65) Prior Publication Data

US 2024/0292898 A1 Sep. 5, 2024

(30) Foreign Application Priority Data

Dec. 23, 2020 (EP) ..... 20217029

(51) Int. Cl.
*A24F 47/00* (2020.01)
*A24F 40/465* (2020.01)
*A24F 40/57* (2020.01)

(52) U.S. Cl.
CPC ..... *A24F 40/465* (2020.01); *A24F 40/57* (2020.01)

(58) Field of Classification Search
CPC ..... A24F 40/465; A24F 40/57
See application file for complete search history.

(56) References Cited

U.S. PATENT DOCUMENTS

2009/0133691 A1 5/2009 Yamada et al.
2019/0159517 A1 5/2019 Ballesteros Gomez et al.
(Continued)

FOREIGN PATENT DOCUMENTS

JP 6577113 B1 9/2019
JP 2019-535283 A 12/2019
(Continued)

OTHER PUBLICATIONS

Combined Russian Office Action and Search Report issued Mar. 3, 2025, in corresponding Russian Patent Application No. 2023118768/03(040402) (with English Translation and English Translation of Category of Cited Documents), 20 pages.
(Continued)

*Primary Examiner* — Eric Yaary
(74) *Attorney, Agent, or Firm* — Oblon, McClelland, Maier & Neustadt, L.L.P.

(57) ABSTRACT

A method for controlling aerosol production in an aerosol-generating device is provided, the aerosol-generating device including an inductive heating arrangement and a power source configured to provide power to the inductive heating arrangement, the method including: controlling the power provided to the inductive heating arrangement to cause a step-wise increase of a temperature of a susceptor associated with the aerosol-generating device from a first operating temperature to a second operating temperature, the susceptor being configured to heat an aerosol-forming substrate, the
(Continued)

power being controlled based on a measured resistance, conductance, or current associated with the susceptor, and in which the measured resistance, conductance, or current associated with the susceptor is determined based on a DC current drawn from the power source. An aerosol-generating device, and an aerosol-generating system including the aerosol-generating device and an aerosol-generating article, are also provided.

18 Claims, 6 Drawing Sheets

(56) References Cited

U.S. PATENT DOCUMENTS

| | | | | |
|---|---|---|---|---|
| 2021/0219617 | A1* | 7/2021 | Lee | A24F 40/50 |
| 2022/0225475 | A1* | 7/2022 | Bleloch | H05B 6/06 |
| 2023/0098358 | A1* | 3/2023 | Forster | A24F 40/465 131/329 |

FOREIGN PATENT DOCUMENTS

| | | | | |
|---|---|---|---|---|
| JP | 2020-54304 | A | 4/2020 | |
| KR | 10-2020-0049637 | A | 5/2020 | |
| KR | 10-2020-0124680 | A | 11/2020 | |
| RU | 2 613 785 | C2 | 3/2017 | |
| RU | 2 732 423 | C2 | 9/2020 | |
| RU | 2 735 592 | C1 | 11/2020 | |
| WO | WO 2014/102091 | A1 | 7/2014 | |
| WO | WO 2015/177255 | A1 | 11/2015 | |
| WO | WO 2015/177256 | A1 | 11/2015 | |
| WO | WO 2015/177294 | A1 | 11/2015 | |
| WO | WO 2018/019855 | A1 | 2/2018 | |
| WO | WO 2018/096000 | A1 | 5/2018 | |
| WO | WO-2019002613 | A1 * | 1/2019 | H05B 6/06 |
| WO | WO 2019/186668 | A1 | 10/2019 | |
| WO | WO 2020/064686 | A1 | 4/2020 | |
| WO | WO 2020/182772 | A1 | 9/2020 | |
| WO | WO 2020/223350 | A1 | 11/2020 | |

OTHER PUBLICATIONS

International Search Report & Written Opinion issued Mar. 31, 2022 in PCT/EP2021/087545 filed on Dec. 23, 2021, 13 pages.
International Preliminary Report on Patentability issued Mar. 30, 2023 in PCT/EP2021/087545 filed on Dec. 23, 2021, 29p ages.
Israel Office Action issued Dec. 1, 2025, in Israel Patent Application No. 303766, 4 pages.
Office Action dated Jan. 29, 2026, issued in corresponding Japanese patent application No. 2023-538789.
Office Action dated May 1, 2026, issued in corresponding Korean patent application No. 10-2023-7024533 (with English translation).

* cited by examiner

AEROSOL-GENERATING DEVICE AND SYSTEM COMPRISING AN INDUCTIVE HEATING DEVICE AND METHOD OF OPERATING THE SAME

The present disclosure relates to an inductive heating device for heating an aerosol-forming substrate. The present invention further relates to an aerosol-generating device comprising such an inductive heating device and a method for controlling aerosol production in the aerosol-generating device.

Aerosol-generating devices may comprise an electrically operated heat source that is configured to heat an aerosol-forming substrate to produce an aerosol. The electrically operated heat source may be an inductive heating device. Inductive heating devices typically comprise an inductor that inductively couples to a susceptor. The inductor generates an alternating magnetic field that causes heating in the susceptor. Typically, the susceptor is in direct contact with the aerosol-forming substrate and heat is transferred from the susceptor to the aerosol-forming substrate primarily by conduction. The temperature of the aerosol-forming substrate may be controlled by controlling the temperature of the susceptor. Therefore, it is important for such aerosol-generating devices to accurately monitor and control the temperature of the susceptor to ensure optimum generation and delivery of an aerosol to a user.

It would be desirable to provide temperature monitoring and control of an inductive heating device that is accurate, reliable and inexpensive.

According to an embodiment of the present invention, there is provided a method for controlling aerosol production in an aerosol-generating device. The device may comprise an inductive heating arrangement and a power source for providing power to the inductive heating arrangement. The method may comprise controlling the power provided to the inductive heating arrangement to cause a step-wise increase of a temperature of a susceptor associated with the aerosol-generating device from a first operating temperature to a second operating temperature, wherein the susceptor is configured to heat an aerosol-forming substrate.

Controlling the power provided to the inductive heating arrangement to cause the step-wise increase of a temperature of the susceptor enables generation of an aerosol over a sustained period encompassing the full user experience of a number of puffs, for example 14 puffs, or a predetermined time interval, such as 6 minutes, where the deliveries (nicotine, flavors, aerosol volume and so on) are substantially constant for each puff throughout the user experience. Specifically, the stepwise increase if the temperature of the susceptor prevents the reduction of aerosol delivery due to substrate depletion in the vicinity of the susceptor and reduced thermodiffusion over time. Furthermore, the step-wise increase in temperature allows for the heat to spread within the substrate at each step.

The step-wise increase of the temperature of the susceptor may comprise at least three consecutive temperature steps, each temperature step having a duration. For the duration of each temperature step, the temperature of the susceptor may be maintained at a predetermined temperature. The duration may be at least 10 seconds. The duration may be between 30 seconds and 200 seconds. The duration may be between 40 seconds and 160 seconds. A first temperature step may have a longer duration than subsequent temperature steps. The duration may be predetermined. The duration may correspond to a predetermined number of user puffs.

The step-wise increase of the temperature of the susceptor may comprise greater than two temperature steps and less than fourteen temperature steps. The step-wise increase of the temperature of the susceptor may comprise greater than two temperature steps and less than eight temperature steps.

The first operating temperature may be sufficient for the aerosol-forming substrate to form an aerosol.

The method may further comprise determining a conductance value or a resistance value associated with the susceptor, wherein the power provided to the inductive heating arrangement is controlled based on the determined conductance value or the determined resistance value.

The inductive heating arrangement may comprise a DC/AC converter and an inductor connected to the DC/AC converter. The susceptor may be arranged to inductively couple to the inductor.

Controlling the power provided to the inductive heating arrangement may comprise interrupting provision of power provided to the DC/AC converter when the determined conductance value exceeds a preset threshold conductance value and resuming the provision of power to the DC/AC converter when the determined conductance value is below the preset threshold conductance value. Controlling the power provided to the inductive heating arrangement may comprise interrupting provision of power provided to the DC/AC converter when the determined resistance value is below a preset threshold resistance value and resuming the provision of power to the DC/AC converter when the determined resistance value is above the preset threshold conductance value.

Power from the power source may be supplied continually to the inductor, via the DC/AC converter. Power from the power source may be supplied to the inductor, via the DC/AC converter, as a plurality of pulses, each pulse separated by a time interval. Controlling the power provided to the inductive heating arrangement may comprise controlling the time interval between each of the plurality of pulses. Controlling the power provided to the inductive heating arrangement may comprise controlling the length of each pulse of the plurality of pulses.

The method may further comprise performing a calibration process for measuring one or more calibration values associated with the susceptor. Controlling the power provided to the inductive heating arrangement may comprise controlling the power such that the temperature of the susceptor is adjusted based on the one or more calibration values.

The one or more calibration values may comprise a first conductance value associated with a first calibration temperature of the susceptor and a second conductance value associated with a second calibration temperature of the susceptor. Controlling the power provided to the inductive heating arrangement may comprise maintaining a conductance value associated with the susceptor between the first conductance value and the second conductance value.

The one or more calibration values may comprise a first resistance value associated with a first calibration temperature of the susceptor and a second resistance value associated with a second calibration temperature of the susceptor. Controlling the power provided to the inductive heating arrangement may comprise maintaining a resistance value associated with the susceptor between the first resistance value and the second resistance value.

The susceptor may comprise a first susceptor material having a first Curie temperature and a second susceptor material having a second Curie temperature. The second Curie temperature may be lower than the first Curie temperature. The second calibration temperature may correspond to the second Curie temperature of the second susceptor material. The first and second susceptor materials are preferably two separate materials that are joined together and therefore are in intimate physical contact with each other, whereby it is ensured that both susceptor materials have the same temperature due to thermal conduction. The two susceptor materials are preferably two layers or strips that are joined along one of their major surfaces. The susceptor may further comprise yet an additional third layer of susceptor material. The third layer of susceptor material is preferably made of the first susceptor material. The thickness of the third layer of susceptor material is preferably less than the thickness of the layer of the second susceptor material.

Controlling the power provided to the inductive heating arrangement may comprise controlling the power such that the temperature of the susceptor is between the first calibration temperature and the second calibration temperature.

The first operating temperature may be greater than or equal to the first calibration temperature. The second operating temperature may be less than or equal to the second calibration temperature.

The first calibration temperature may be between 150 degrees Celsius and 350 degrees Celsius and the second calibration temperature may be between 200 degrees Celsius and 400 degrees Celsius. A temperature difference between the first calibration temperature and the second calibration temperature may be at least 50 degrees Celsius.

The calibration process may be performed during user operation of the aerosol-generating device for producing an aerosol.

Accordingly, the calibration values used to control the heating process are more accurate and reliable than if the calibration process were performed at manufacturing. This is especially important if the susceptor forms part of a separate aerosol-generating article that does not form part of the aerosol generating device. In such circumstances calibration at manufacturing is not possible.

The calibration process may be performed periodically based on one or more of: a predetermined duration of time, a predetermined number of user puffs, a predetermined number of temperature steps, and a measured voltage of the power source.

Conditions may change during user operation of the aerosol-generating device. For example, the susceptor may move relative to the inductive heating arrangement, the power source (for example, a battery) may lose some efficiency over time and so on. Accordingly, performing the calibration process periodically ensures the reliability of the calibration values, thereby ensuring that optimal temperature regulation is maintained throughout use of the aerosol-generating device.

Performing the calibration process may comprise the steps of: (i) controlling the power provided to the inductive heating arrangement to cause an increase of the temperature of the susceptor; (ii) monitoring at least a current value of the inductive heating arrangement; (iii) interrupting provision of power to the inductive heating arrangement when the at least the current value reaches a maximum, wherein the current value at the maximum corresponds to the second calibration temperature of the susceptor; and (iv) when the current value associated with the susceptor reaches a minimum, controlling the power provided to the inductive heating arrangement to cause an increase of the temperature of the susceptor, wherein the current value at the minimum corresponds to the first calibration temperature of the susceptor. Monitoring the at least a current value of the inductive heating arrangement may further comprise monitoring a voltage value of the inductive heating arrangement.

The method may further comprise repeating steps (i) to (iv) when the conductance value associated with the susceptor reaches the minimum. Subsequent to repeating steps (i) to (iv): a conductance value corresponding to the current value at the maximum may be stored as the second calibration value and a conductance value corresponding to the current value at the minimum may be stored as the first calibration value. Alternatively, a resistance value corresponding to the current value at the maximum may be stored as the second calibration value and a resistance value corresponding to the current value at the minimum may be stored as the first calibration value.

Performing the calibration process may comprise the steps of: (i) controlling the power provided to the inductive heating arrangement to cause an increase of the temperature of the susceptor; (ii) monitoring a conductance value or a resistance value associated with the susceptor; (iii) interrupting provision of power to the inductive heating arrangement when the conductance value reaches a maximum or when the resistance value reaches a minimum, wherein the maximum current value or the minimum resistance value corresponds to the second calibration temperature of the susceptor; and (iv) when the conductance value reaches a minimum or the resistance value reaches a maximum, controlling the power provided to the inductive heating arrangement to cause an increase of the temperature of the susceptor, wherein the minimum conductance value or the maximum resistance value corresponds to the first calibration temperature of the susceptor.

Steps (i) to (iv) may be repeated when the conductance value reaches the minimum or the resistance value reaches the maximum.

Subsequent to repeating steps (i) to (iv), the maximum conductance value or the minimum resistance value may be stored as the second conductance value and the minimum conductance value or the maximum resistance value may be stored as the first conductance value.

The calibration process is both quick and reliable without delaying aerosol-production. Furthermore, repeating the steps of the calibration process significantly improves subsequent temperature regulation based on the calibration values obtained from the repeated calibration process because heat has had more time to distribute within the substrate. Performing the calibration process based on at least a measured current value assumes that the voltage of the power source remains constant. Thus, monitoring a conductance value or a resistance value (and therefore using both measured values of current and voltage) during the calibration process further improves the reliability of the calibration in case the voltage of the power source changes over a long period of time (for example, after being recharged many times).

The method may further comprise performing a preheating process to heat the susceptor to the first calibration temperature. The pre-heating process may have a predetermined duration. The pre-heating process allows for heat to spread within the substrate before launching the calibration process, thereby further improving the reliability of the calibration values.

Performing the preheating process may comprise: controlling the power provided to the inductive heating arrangement to cause an increase of the temperature of the susceptor; monitoring a at least a current value of the inductive heating arrangement; and interrupting provision of power to the inductive heating arrangement when the current value reaches a minimum, wherein the current value at the minimum corresponds to the first calibration temperature of the susceptor.

If the current value reaches a minimum during the predetermined duration of the pre-heating process, the method may comprise interrupting the provision of power to the inductive heating arrangement to cause a decrease of the temperature of the susceptor and subsequently resuming the provision of power to the inductive heating arrangement to cause an increase of the temperature of the susceptor to the first calibration temperature. Interrupting the provision of power to the inductive heating arrangement and resuming providing power to the inductive heating arrangement is repeated for the predetermined duration of the pre-heating process. The method may further comprise, if the current value of the susceptor does not reach a minimum during the predetermined duration of the pre-heating process, ceasing operation of the aerosol-generating device.

Performing the preheating process may comprise: controlling the power provided to the inductive heating arrangement to cause an increase of the temperature of the susceptor; monitoring a conductance value or a resistance value associated with the susceptor; and interrupting provision of power to the inductive heating arrangement when the conductance value reaches a minimum or when the resistance value reaches a maximum, wherein the conductance value at the minimum or the resistance value at the maximum corresponds to the first calibration temperature of the susceptor.

If, during the predetermined duration of the pre-heating process, the conductance value reaches a minimum or the resistance value reaches a maximum, the method may further comprise interrupting the provision of power to the inductive heating arrangement to cause a decrease of the temperature of the susceptor and subsequently resuming the provision of power to the inductive heating arrangement to cause an increase of the temperature of the susceptor to the first calibration temperature. Interrupting the provision of power to the inductive heating arrangement and the resuming providing power to the inductive heating arrangement may be repeated for the predetermined duration of the preheating process. If, during the predetermined duration of the pre-heating process, the conductance value does not reach a minimum or the resistance value does not reach a maximum, the method may further comprise ceasing operation of the aerosol-generating device.

Performing the steps of the pre-heating process for the pre-determined duration enables heat to spread within the substrate in time to reach the minimum conductance value measured during the calibration process no matter what the physical condition of the substrate (for example, if the substrate is dry or humid). This ensures reliability of the calibration process.

Further, the susceptor is preferably comprised in an aerosol-generating article that is configured to be inserted into the aerosol-generating device. Aerosol-generating articles that are not configured to be used with the aerosol-generating device will not exhibit the same behavior as authorized aerosol-generating articles. Specifically, for aerosol-generating articles that are not configured to be used with the aerosol-generating device, the minimum current/conductance value or the maximum resistance value will not be observed during the pre-determined duration of the pre-heating process. Accordingly, this prevents the use of non-authorized aerosol-generating articles.

The method may further comprise, at the input side of the DC/AC converter, measuring a DC current drawn from the power source. The conductance value or the resistance value associated with the susceptor may be determined based on a DC supply voltage of the power source and from the DC current drawn from the power source. The method may further comprise measuring, at the input side of the DC/AC converter, the DC supply voltage of the power source. This is due to the fact that there is a monotonous relationship between the actual conductance (which cannot be determined if the susceptor forms part of the article) of the susceptor and the apparent conductance determined in this way (because the susceptor will impart the conductance of the LCR-circuit (of the DC/AC converter) it will be coupled to, because the majority of the load (R) will be due to the resistance of the susceptor. The conductance is 1/R. Hence, when we in this text refer to the conductance of the susceptor, we are in fact referring to the apparent conductance if the susceptor forms part of a separate aerosol-generating article.

The first operating temperature may be between 150 degrees Celsius and 330 degrees Celsius and the second operating temperature is between 200 degrees Celsius and 400 degrees Celsius. A temperature difference between the first operating temperature and the second operating temperature may be at least 30 degrees Celsius.

The step-wise increase of the temperature of the susceptor may comprise: a first temperature step having a temperature corresponding to the first operating temperature, wherein the first operating temperature is 330 degrees Celsius, a second temperature step having a temperature of 340 degrees Celsius, a third temperature step having a temperature of 345 degrees Celsius, a fourth temperature step having a temperature of 355 degrees Celsius, and a fifth temperature step having a temperature corresponding to the second operating temperature, wherein the second operating temperature is 380 degrees Celsius.

The susceptor and the aerosol-forming substrate may be form part of an aerosol-generating article, wherein the aerosol-generating device may be configured to removably receive the aerosol-generating article.

According to another embodiment of the present invention, there is provided an aerosol-generating device comprising: a power source for providing a DC supply voltage and a DC current and power supply electronics connected to the power source. The power supply electronics comprise: a DC/AC converter; an inductor connected to the DC/AC converter for the generation of an alternating magnetic field when energized by an alternating current from the DC/AC converter, the inductor being couplable a susceptor, wherein the susceptor is configured to heat an aerosol-forming substrate; and a controller configured to control the power provided to the power supply electronics to cause a step-wise increase of a temperature of the susceptor from a first operating temperature to a second operating temperature.

The step-wise increase of the temperature of the susceptor may comprise at least three consecutive temperature steps, each temperature step having a duration. For the duration of each temperature step, the controller may be configured to control the power provided to the power supply electronics to maintain the temperature of the susceptor at a predetermined temperature. The duration may be at least 10 seconds. The duration may be between 30 seconds and 200 seconds. The duration may be between 40 seconds and 160 seconds. A first temperature step may have a longer duration than subsequent temperature steps. The duration of each temperature step may be predetermined. The duration may correspond to a predetermined number of user puffs. The step-wise increase of the temperature of the susceptor may comprise greater than two temperature steps and less than fourteen temperature steps. The step-wise increase of the temperature of the susceptor comprises greater than two temperature steps and less than eight temperature steps. The first operating temperature may be sufficient for the aerosol-forming substrate to form an aerosol.

The controller may be configured to determine a conductance value or a resistance value associated with the susceptor. The controller may be configured to control the power provided to the power supply electronics based on the determined conductance value or the determined resistance value Controlling the power provided to the power supply electronics may comprise interrupting provision of power provided to the DC/AC converter when the determined conductance value exceeds a preset threshold conductance value and resuming the provision of power to the DC/AC converter when the determined conductance value is below the preset threshold conductance value.

Controlling the power provided to the inductive heating arrangement may comprise interrupting provision of power provided to the DC/AC converter when the determined resistance value is below a preset threshold resistance value and resuming the provision of power to the DC/AC converter when the determined resistance value is above the preset threshold conductance value.

The power supply electronics may be configured to continually supply power from the power source to the inductor, via the DC/AC converter.

The power supply electronics may be configured to supply power from the power source to the inductor, via the DC/AC converter, as a plurality of pulses, each pulse separated by a time interval.

Controlling the power provided to the power supply electronics may comprise controlling the time interval between each of the plurality of pulses. Controlling the power provided to the power supply electronics may comprise controlling the length of each pulse of the plurality of pulses.

The controller may be further configured to perform a calibration process for measuring one or more calibration values associated with the susceptor.

Controlling the power provided to the power supply electronics may comprise controlling the power such that the temperature of the susceptor is adjusted based on the one or more calibration values.

The one or more calibration values may comprise a first conductance value associated with a first calibration temperature of the susceptor and a second conductance value associated with a second calibration temperature of the susceptor. Controlling the power provided to the power supply electronics may comprise maintaining a conductance value associated with the susceptor between the first conductance value and the second conductance value.

The one or more calibration values may comprise a first resistance value associated with a first calibration temperature of the susceptor and a second resistance value associated with a second calibration temperature of the susceptor.

Controlling the power provided to the inductive heating arrangement may comprise maintaining a resistance value associated with the susceptor between the first resistance value and the second resistance value.

The second calibration temperature of the susceptor may correspond to a Curie temperature of a material of the susceptor.

Controlling the power provided to the power supply electronics may comprise controlling the power such that the temperature of the susceptor is between the first calibration temperature and the second calibration temperature.

The first operating temperature may be greater than or equal to the first calibration temperature. The second operating temperature may be less than or equal to the second calibration temperature.

The first calibration temperature may be between 150 degrees Celsius and 350 degrees Celsius and the second calibration temperature is between 200 degrees Celsius and 400 degrees Celsius. A temperature difference between the first calibration temperature and the second calibration temperature may be at least 50 degrees Celsius.

The calibration process may be performed during user operation of the aerosol-generating device for producing an aerosol. The calibration process may be performed periodically based on one or more of: a predetermined duration of time, a predetermined number of user puffs, a predetermined number of temperature steps, and a measured voltage of the power source.

Performing the calibration process may comprise the steps of: (i) controlling the power provided to the power supply electronics to cause an increase of the temperature of the susceptor; (ii) monitoring at least a current value of the power supply electronics; (iii) interrupting provision of power to the power supply electronics when the current value reaches a maximum, wherein the current value at the maximum corresponds to the second calibration temperature of the susceptor; and (iv) when the current value reaches a minimum, controlling the power provided to the power supply electronics to cause an increase of the temperature of the susceptor, wherein the current value at the minimum corresponds to the first calibration temperature. Monitoring the at least a current value of the power supply electronics may comprise monitoring a voltage value of the power supply electronics.

Performing the calibration process may further comprise: repeating steps (i) to (iv) when the current value of the power supply electronics reaches the minimum. The controller may be further configured to, subsequent to repeating steps i) to iv): store a conductance value corresponding to the current value at the maximum as the second calibration value and store a conductance value corresponding to the current value at the minimum as the first calibration value, or store a resistance value corresponding to the current value at the maximum as the second calibration value and store a resistance value corresponding to the current value at the minimum as the first calibration value.

Performing the calibration process may comprise the steps of: (i) controlling the power provided to the inductive heating arrangement to cause an increase of the temperature of the susceptor; (ii) monitoring a conductance value or a resistance value associated with the susceptor; (iii) interrupting provision of power to the inductive heating arrangement when the conductance value reaches a maximum or when the resistance value reaches a minimum, wherein the maximum conductance value or the minimum resistance value corresponds to the second calibration temperature of the susceptor; and (iv) when the conductance value reaches a minimum or the resistance value reaches a maximum, controlling the power provided to the inductive heating arrangement to cause an increase of the temperature of the susceptor, wherein the minimum conductance value or the maximum resistance value corresponds to the first calibration temperature of the susceptor.

Performing the calibration process may further comprise repeating steps i) to iv) when the conductance value reaches the minimum or the resistance value reaches the maximum. Subsequent to repeating steps (i) to (iv), the controller may be further configured to store the conductance value at the maximum as the second calibration value and to store the conductance value at the minimum as the first calibration value. Subsequent to repeating steps (i) to (iv), the controller may be further configured to store the resistance value at the minimum as the second calibration value and to store the resistance value at the maximum as the first calibration value.

The controller may be further configured to perform a pre-heating process to heat the susceptor to the first calibration temperature. The pre-heating process may have a predetermined duration. Performing the preheating process may comprise: controlling the power provided to the power supply electronics to cause an increase of the temperature of the susceptor; monitoring at least a current value of the power supply electronics; and interrupting provision of power to the power supply electronics when the current value reaches a minimum, wherein the current value at the minimum corresponds to the first calibration temperature of the susceptor.

Performing the pre-heating process may further comprise, if the current value reaches a minimum during the predetermined duration of the pre-heating process, interrupting the provision of power to the power supply electronics to cause a decrease of the temperature of the susceptor and subsequently resuming the provision of power to the power supply electronics to cause an increase of the temperature of the susceptor to the first calibration temperature. Interrupting the provision of power to the power supply electronics and resuming providing power to the power supply electronics may be repeated for the predetermined duration of the pre-heating process.

The controller may be further configured to, if the current value of the susceptor does not reach a minimum during the predetermined duration of the pre-heating process, generate a control signal to cease operation of the aerosol-generating device.

Performing the preheating process may comprise: controlling the power provided to the inductive heating arrangement to cause an increase of the temperature of the susceptor; monitoring a conductance value or a resistance value associated with the susceptor; and interrupting provision of power to the inductive heating arrangement when the conductance value reaches a minimum or when the resistance value reaches a maximum, wherein the current value at the minimum or at the resistance value at the maximum corresponds to the first calibration temperature of the susceptor.

If, during the predetermined duration of the pre-heating process, the conductance value reaches a minimum or the resistance value reaches a maximum, the provision of power to the inductive heating arrangement may be interrupted to cause a decrease of the temperature of the susceptor and subsequently the provision of power to the inductive heating arrangement may be resumed to cause an increase of the temperature of the susceptor to the first calibration temperature. Interrupting the provision of power to the inductive heating arrangement and the resuming providing power to the inductive heating arrangement may be repeated for the predetermined duration of the preheating process.

If, during the predetermined duration of the pre-heating process, the conductance value does not reach a minimum or the resistance value does not reach a maximum, operation of the aerosol-generating device may be ceased.

The aerosol-generating device may further comprise a current sensor configured to measure, at the input side of the DC/AC converter, a DC current drawn from the power source. The conductance value and the resistance value associated with the susceptor may be determined from a DC supply voltage of the power source and from the DC current drawn from the power source. The aerosol-generating device may further comprise a voltage sensor configured to measure, at the input side of the DC/AC converter, the DC supply voltage of the power source.

The first operating temperature may be between 150 degrees Celsius and 330 degrees Celsius and the second operating temperature is between 200 degrees Celsius and 400 degrees Celsius. A temperature difference between the first operating temperature and the second operating temperature may be at least 30 degrees Celsius.

The step-wise increase of the temperature of the susceptor may comprise: a first temperature step having a temperature corresponding to the first operating temperature, wherein the first operating temperature is 330 degrees Celsius, a second temperature step having a temperature of 340 degrees Celsius, a third temperature step having a temperature of 345 degrees Celsius, a fourth temperature step having a temperature of 355 degrees Celsius, and a fifth temperature step having a temperature corresponding to the second operating temperature, wherein the second operating temperature is 380 degrees Celsius.

The power supply electronics may further comprise a matching network for matching the impedance of the inductor to that of the susceptor.

The aerosol-generating device may further comprise a housing having a cavity configured to removably receive an aerosol-generating article. The aerosol-generating article may comprise the aerosol-forming substrate and the susceptor.

According to another embodiment of the present invention, there is provided an aerosol-generating system, comprising the aerosol-generating device described above and the aerosol-generating article. The aerosol-generating article may comprise the aerosol-forming substrate and the susceptor.

The susceptor may comprise a first susceptor material and a second susceptor material, wherein the first susceptor material is disposed in physical contact with the second susceptor material. The first susceptor material may be one of aluminum, iron, and stainless steel, and wherein the second susceptor material is nickel or a nickel alloy. The first susceptor material may have a first Curie temperature and the second susceptor material may have a second Curie temperature. The second Curie temperature may be lower than the first Curie temperature. The second calibration temperature may correspond to the second Curie temperature of the second susceptor material.

As used herein, the term "aerosol-generating device" refers to a device that interacts with an aerosol-forming substrate to generate an aerosol. An aerosol-generating device may interact with one or both of an aerosol-generating article comprising an aerosol-forming substrate, and a cartridge comprising an aerosol-forming substrate. In some examples, the aerosol-generating device may heat the aerosol-forming substrate to facilitate release of volatile compounds from the substrate. An electrically operated aerosol-generating device may comprise an atomizer, such as an electric heater, to heat the aerosol-forming substrate to form an aerosol.

As used herein, the term "aerosol-generating system" refers to the combination of an aerosol-generating device with an aerosol-forming substrate. When the aerosol-forming substrate forms part of an aerosol-generating article, the aerosol-generating system refers to the combination of the aerosol-generating device with the aerosol-generating article. In the aerosol-generating system, the aerosol-forming substrate and the aerosol-generating device cooperate to generate an aerosol.

As used herein, the term "aerosol-forming substrate" refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or may comprise both solid and liquid components. An aerosol-forming substrate may be part of an aerosol-generating article.

As used herein, the term "aerosol-generating article" refers to an article comprising an aerosol-forming substrate that is capable of releasing volatile compounds that can form an aerosol. An aerosol-generating article may be disposable. An aerosol-generating article comprising an aerosol-forming substrate comprising tobacco may be referred to herein as a tobacco stick.

An aerosol-forming substrate may comprise nicotine. An aerosol-forming substrate may comprise tobacco, for example may comprise a tobacco-containing material containing volatile tobacco flavor compounds, which are released from the aerosol-forming substrate upon heating. In preferred embodiments an aerosol-forming substrate may comprise homogenized tobacco material, for example cast leaf tobacco. The aerosol-forming substrate may comprise both solid and liquid components. The aerosol-forming substrate may comprise a tobacco-containing material containing volatile tobacco flavor compounds, which are released from the substrate upon heating. The aerosol-forming substrate may comprise a non-tobacco material. The aerosol-forming substrate may further comprise an aerosol former. Examples of suitable aerosol formers are glycerin and propylene glycol.

As used herein, "aerosol-cooling element" refers to a component of an aerosol-generating article located downstream of the aerosol-forming substrate such that, in use, an aerosol formed by volatile compounds released from the aerosol-forming substrate passes through and is cooled by the aerosol cooling element before being inhaled by a user. An aerosol cooling element has a large surface area, but causes a low pressure drop. Filters and other mouthpieces that produce a high pressure drop, for example filters formed from bundles of fibers, are not considered to be aerosol-cooling elements. Chambers and cavities within an aerosol-generating article are not considered to be aerosol cooling elements.

As used herein, the term "mouthpiece" refers to a portion of an aerosol-generating article, an aerosol-generating device or an aerosol-generating system that is placed into a user's mouth in order to directly inhale an aerosol.

As used herein, the term "susceptor" refers to an element comprising a material that is capable of converting the energy of a magnetic field into heat. When a susceptor is located in an alternating magnetic field, the susceptor is heated. Heating of the susceptor may be the result of at least one of hysteresis losses and eddy currents induced in the susceptor, depending on the electrical and magnetic properties of the susceptor material.

As used herein when referring to an aerosol-generating device, the terms "upstream" and "front", and "downstream" and "rear", are used to describe the relative positions of components, or portions of components, of the aerosol-generating device in relation to the direction in which air flows through the aerosol-generating device during use thereof. Aerosol-generating devices according to the invention comprise a proximal end through which, in use, an aerosol exits the device. The proximal end of the aerosol-generating device may also be referred to as the mouth end or the downstream end. The mouth end is downstream of the distal end. The distal end of the aerosol-generating article may also be referred to as the upstream end. Components, or portions of components, of the aerosol-generating device may be described as being upstream or downstream of one another based on their relative positions with respect to the airflow path of the aerosol-generating device.

As used herein when referring to an aerosol-generating article, the terms "upstream" and "front", and "downstream" and "rear", are used to describe the relative positions of components, or portions of components, of the aerosol-generating article in relation to the direction in which air flows through the aerosol-generating article during use thereof. Aerosol-generating articles according to the invention comprise a proximal end through which, in use, an aerosol exits the article. The proximal end of the aerosol-generating article may also be referred to as the mouth end or the downstream end. The mouth end is downstream of the distal end. The distal end of the aerosol-generating article may also be referred to as the upstream end. Components, or portions of components, of the aerosol-generating article may be described as being upstream or downstream of one another based on their relative positions between the proximal end of the aerosol-generating article and the distal end of the aerosol-generating article. The front of a component, or portion of a component, of the aerosol-generating article is the portion at the end closest to the upstream end of the aerosol-generating article. The rear of a component, or portion of a component, of the aerosol-generating article is the portion at the end closest to the downstream end of the aerosol-generating article.

As used herein, the term "inductively couple" refers to the heating of a susceptor when penetrated by an alternating magnetic field. The heating may be caused by the generation of eddy currents in the susceptor. The heating may be caused by magnetic hysteresis losses.

As used herein, the term "puff" means the action of a user drawing an aerosol into their body through their mouth or nose.

The invention is defined in the claims. However, below there is provided a non-exhaustive list of non-limiting examples. Any one or more of the features of these examples may be combined with any one or more features of another example, embodiment, or aspect described herein.

Example Ex1: A method for controlling aerosol production in an aerosol-generating device, the device comprising an inductive heating arrangement and a power source for providing power to the inductive heating arrangement, and the method comprising: controlling the power provided to the inductive heating arrangement to cause a step-wise increase of a temperature of a susceptor associated with the aerosol-generating device from a first operating temperature to a second operating temperature, wherein the susceptor is configured to heat an aerosol-forming substrate.

Example Ex2: The method according to example Ex1, wherein the step-wise increase of the temperature of the susceptor comprises at least three consecutive temperature steps, each temperature step having a duration.

Example Ex3: The method according to example Ex2, wherein, for the duration of each temperature step, the temperature of the susceptor is maintained at a predetermined temperature.

Example Ex4: The method according to example Ex2 or Ex3, wherein the duration is at least 10 seconds.

Example Ex5: The method according to example Ex2 or Ex3, wherein the duration is between 30 seconds and 200 seconds.

Example Ex6: The method according to any of examples Ex2 or Ex3, wherein the duration is between 40 seconds and 160 seconds.

Example Ex7: The method according to any of examples Ex2 to Ex6, wherein the duration of each temperature step is predetermined.

Example Ex8: The method according to example Ex2 or Ex3, wherein the duration corresponds to a predetermined number of user puffs.

Example Ex9: The method according to any of examples Ex2 to Ex8, wherein a first temperature step has a longer duration than subsequent temperature steps.

Example Ex10: The method according to any of examples Ex1 to Ex9, wherein the step-wise increase of the temperature of the susceptor comprises greater than two temperature steps and less than fourteen temperature steps.

Example Ex11: The method according to any of examples Ex1 to Ex10, wherein the step-wise increase of the temperature of the susceptor comprises greater than two temperature steps and less than eight temperature steps.

Example Ex12: The method according to any of examples Ex1 to Ex11, wherein the first operating temperature is sufficient for the aerosol-forming substrate to form an aerosol.

Example Ex13: The method according to any of examples Ex1 to Ex12, further comprising: determining a conductance value or a resistance value associated with the susceptor, wherein the power provided to the inductive heating arrangement is controlled based on the determined conductance value or the determined resistance value.

Example Ex14: The method according to example Ex13, wherein the inductive heating arrangement comprises a DC/AC converter and an inductor connected to the DC/AC converter, and wherein the susceptor is arranged to inductively couple to the inductor.

Example Ex15: The method according to example Ex14, wherein controlling the power provided to the inductive heating arrangement comprises interrupting provision of power provided to the DC/AC converter when the determined conductance value exceeds a preset threshold conductance value and resuming the provision of power to the DC/AC converter when the determined conductance value is below the preset threshold conductance value, or wherein controlling the power provided to the inductive heating arrangement comprises interrupting provision of power provided to the DC/AC converter when the determined resistance value is below a preset threshold resistance value and resuming the provision of power to the DC/AC converter when the determined resistance value is above the preset threshold conductance value.

Example Ex16: The method according to example Ex14 or Ex15, wherein power from the power source is supplied continually to the inductor, via the DC/AC converter.

Example Ex17: The method according to any of examples Ex14 to Ex16, wherein power from the power source is supplied to the inductor, via the DC/AC converter, as a plurality of pulses, each pulse separated by a time interval.

Example Ex18: The method according to example Ex17, wherein controlling the power provided to the inductive heating arrangement comprises controlling the time interval between each of the plurality of pulses.

Example Ex19: The method according to example Ex17, wherein controlling the power provided to the inductive heating arrangement comprises controlling the length of each pulse of the plurality of pulses.

Example Ex20: The method according to any of examples Ex1 to Ex19, further comprising performing a calibration process for measuring one or more calibration values associated with the susceptor.

Example Ex21: The method according to example Ex20, wherein controlling the power provided to the inductive heating arrangement comprises controlling the power such that the temperature of the susceptor is adjusted based on the one or more calibration values.

Example Ex22: The method according to example Ex20 or Ex21, wherein the one or more calibration values comprise a first conductance value associated with a first calibration temperature of the susceptor and a second conductance value associated with a second calibration temperature of the susceptor.

Example Ex23: The method according to example Ex22, wherein controlling the power provided to the inductive heating arrangement comprises maintaining a conductance value associated with the susceptor between the first conductance value and the second conductance value.

Example Ex24: The method according to example Ex20 or Ex21, wherein the one or more calibration values comprise a first resistance value associated with a first calibration temperature of the susceptor and a second resistance value associated with a second calibration temperature of the susceptor.

Example Ex25: The method according to example Ex24, wherein controlling the power provided to the inductive heating arrangement comprises maintaining a resistance value associated with the susceptor between the first resistance value and the second resistance value.

Example Ex26: The method according to any of examples Ex22 to Ex25, wherein the susceptor comprises a first susceptor material having a first Curie temperature and a second susceptor material having a second Curie temperature, wherein the second Curie temperature is lower than the first Curie temperature, and wherein the second calibration temperature corresponds to the second Curie temperature of the second susceptor material.

Example Ex27: The method according to any of examples Ex22 to Ex26, wherein controlling the power provided to the inductive heating arrangement comprises controlling the power such that the temperature of the susceptor is between the first calibration temperature and the second calibration temperature.

Example Ex28: The method according to any of examples Ex22 to Ex27, wherein the first operating temperature is greater than or equal to the first calibration temperature and wherein the second operating temperature is less than or equal to the second calibration temperature.

Example Ex29: The method according to any of examples Ex22 to Ex28, wherein the first calibration temperature is between 150 degrees Celsius and 350 degrees Celsius and the second calibration temperature is between 200 degrees Celsius and 400 degrees Celsius, wherein a temperature difference between the first calibration temperature and the second calibration temperature is at least 50 degrees Celsius.

Example Ex30: The method according to any of examples Ex20 to Ex29, wherein the calibration process is performed during user operation of the aerosol-generating device for producing an aerosol.

Example Ex31: The method according to any of examples Ex20 to Ex30, wherein the calibration process is performed periodically based on one or more of: a predetermined duration of time, a predetermined number of user puffs, a predetermined number of temperature steps, and a measured voltage of the power source.

Example Ex32: The method according to any of examples Ex22 to Ex31, wherein performing the calibration process comprises the steps of: (i) controlling the power provided to the inductive heating arrangement to cause an increase of the temperature of the susceptor; (ii) monitoring at least a current value of the inductive heating arrangement; (iii) interrupting provision of power to the inductive heating arrangement when the current value reaches a maximum, wherein the current value at the maximum corresponds to the second calibration temperature of the susceptor; and (iv) when the current value associated with the susceptor reaches a minimum, controlling the power provided to the inductive heating arrangement to cause an increase of the temperature of the susceptor, wherein the current value at the minimum corresponds to the first calibration temperature of the susceptor.

Example Ex33: The method according to example Ex32, wherein monitoring the at least a current value of the inductive heating arrangement further comprises monitoring a voltage value of the inductive heating arrangement.

Example Ex34: The method according to example Ex32 or Ex33, further comprising repeating steps (i) to (iv) when the current value reaches the minimum.

Example Ex35: The method according to example Ex34, further comprising, subsequent to repeating steps i) to iv): storing a conductance value corresponding to the current value at the maximum as the second calibration value and storing a conductance value corresponding to the current value at the minimum as the first calibration value, or storing a resistance value corresponding to the current value at the maximum as the second calibration value and storing a resistance value corresponding to the current value at the minimum as the first calibration value.

Example Ex36: The method according to any of examples Ex22 to Ex29, wherein performing the calibration process comprises the steps of: i) controlling the power provided to the inductive heating arrangement to cause an increase of the temperature of the susceptor; ii) monitoring a conductance value or a resistance value associated with the susceptor; iii) interrupting provision of power to the inductive heating arrangement when the conductance value reaches a maximum or when the resistance value reaches a minimum, wherein the maximum conductance value or the minimum resistance value corresponds to the second calibration temperature of the susceptor; and iv) when the conductance value reaches a minimum or the resistance value reaches a maximum, controlling the power provided to the inductive heating arrangement to cause an increase of the temperature of the susceptor, wherein the minimum conductance value or the maximum resistance value corresponds to the first calibration temperature of the susceptor.

Example Ex37: The method according to example Ex36, further comprising repeating steps i) to iv) when the conductance value reaches the minimum or the resistance value reaches the maximum.

Example Ex38: The method according to example Ex37, further comprising, subsequent to repeating steps (i) to (iv), storing the maximum conductance value as the second conductance value and storing the minimum conductance value as the first calibration value, or storing the minimum resistance value as the second calibration value and storing the maximum resistance value as the first calibration value.

Example Ex39: The method according to any of examples Ex22 to Ex38, further comprising performing a pre-heating process to heat the susceptor to the first calibration temperature, wherein the pre-heating process has a predetermined duration.

Example Ex40: The method according to example Ex39, wherein performing the preheating process comprises: controlling the power provided to the inductive heating arrangement to cause an increase of the temperature of the susceptor; monitoring at least a current value associated with the susceptor; and interrupting provision of power to the inductive heating arrangement when the current value reaches a minimum, wherein the current value at the minimum corresponds to the first calibration temperature of the susceptor.

Example Ex41: The method of example Ex40, further comprising, if the current value reaches a minimum during the predetermined duration of the pre-heating process, interrupting the provision of power to the inductive heating arrangement to cause a decrease of the temperature of the susceptor and subsequently resuming the provision of power to the inductive heating arrangement to cause an increase of the temperature of the susceptor to the first calibration temperature.

Example Ex42: The method of example Ex41, wherein interrupting the provision of power to the inductive heating arrangement and the resuming providing power to the inductive heating arrangement is repeated for the predetermined duration of the preheating process.

Example Ex43: The method according to example Ex40, further comprising: if the current value of the susceptor does not reach a minimum during the predetermined duration of the pre-heating process, ceasing operation of the aerosol-generating device.

Example Ex44: The method according to example Ex39, wherein performing the preheating process comprises: controlling the power provided to the inductive heating arrangement to cause an increase of the temperature of the susceptor; monitoring a conductance value or a resistance value associated with the susceptor; and interrupting provision of power to the inductive heating arrangement when the conductance value reaches a minimum or when the resistance value reaches a maximum, wherein the conductance value at the minimum or the resistance value at the maximum corresponds to the first calibration temperature of the susceptor.

Example Ex45: The method according to example Ex44, further comprising, if, during the predetermined duration of the pre-heating process, the conductance value reaches a minimum or the resistance value reaches a maximum, interrupting the provision of power to the inductive heating arrangement to cause a decrease of the temperature of the susceptor and subsequently resuming the provision of power to the inductive heating arrangement to cause an increase of the temperature of the susceptor to the first calibration temperature.

Example Ex46: The method according to example Ex45, wherein interrupting the provision of power to the inductive heating arrangement and the resuming providing power to the inductive heating arrangement is repeated for the predetermined duration of the preheating process.

Example Ex47: The method according to example Ex44, further comprising: if, during the predetermined duration of the pre-heating process, the conductance value does not reach a minimum or the resistance value does not reach a maximum, ceasing operation of the aerosol-generating device.

Example Ex48: The method according to any of examples Ex14 to Ex47, further comprising, at the input side of the DC/AC converter, measuring a DC current drawn from the power source, wherein the conductance value and the resistance value associated with the susceptor is determined based on a DC supply voltage of the power source and from the DC current drawn from the power source.

Example Ex49: The method according to example Ex48, further comprising measuring, at the input side of the DC/AC converter, the DC supply voltage of the power source.

Example Ex50: The method according to any of examples Ex1 to Ex49, wherein the first operating temperature is between 150 degrees Celsius and 330 degrees Celsius and the second operating temperature is between 200 degrees Celsius and 400 degrees Celsius, and wherein a temperature difference between the first operating temperature and the second operating temperature is at least 30 degrees Celsius.

Example Ex51: The method according to examples Ex1 to Ex50, wherein the step-wise increase of the temperature of the susceptor comprises: a first temperature step having a temperature corresponding to the first operating temperature, wherein the first operating temperature is 330 degrees Celsius, a second temperature step having a temperature of 340 degrees Celsius, a third temperature step having a temperature of 345 degrees Celsius, a fourth temperature step having a temperature of 355 degrees Celsius, and a fifth temperature step having a temperature corresponding to the second operating temperature, wherein the second operating temperature is 380 degrees Celsius.

Example Ex52: The method according to any of examples Ex1 to Ex51, wherein the susceptor and the aerosol-forming substrate form part of an aerosol-generating article, wherein the aerosol-generating device is configured to removably receive the aerosol-generating article.

Example Ex53: An aerosol-generating device comprising: a power source for providing a DC supply voltage and a DC current; power supply electronics connected to the power source, wherein the power supply electronics comprises: a DC/AC converter; an inductor connected to the DC/AC converter for the generation of an alternating magnetic field when energized by an alternating current from the DC/AC converter, the inductor being couplable to a susceptor, wherein the susceptor is configured to heat an aerosol-forming substrate; and a controller configured to control the power provided to the power supply electronics to cause a step-wise increase of a temperature of the susceptor from a first operating temperature to a second operating temperature.

Example Ex54: The aerosol-generating device according to example Ex53, wherein the step-wise increase of the temperature of the susceptor comprises at least three consecutive temperature steps, each temperature step having a duration.

Example Ex55: The aerosol-generating device according to example Ex54, wherein, for the duration of each temperature step, the controller is configured to control the power provided to the power supply electronics to maintain the temperature of the susceptor at a predetermined temperature.

Example Ex56: The aerosol-generating device according to example Ex54 or Ex55, wherein the duration is at least 10 seconds.

Example Ex57: The aerosol-generating device according to example Ex54 or Ex55, wherein the duration is between 30 seconds and 200 seconds.

Example Ex58: The aerosol-generating device according to example Ex54 or Ex55, wherein the duration is between 40 seconds and 160 seconds.

Example Ex59: The aerosol-generating device according to example Ex54 or Ex55, wherein the duration corresponds to a predetermined number of user puffs.

Example Ex60: The aerosol-generating device according to any of examples Ex54 to Ex59, wherein a first temperature step has a longer duration than subsequent temperature steps.

Example Ex61: The aerosol-generating device according to any of examples Ex54 to Ex58, wherein the duration is predetermined.

Example Ex62: The aerosol-generating device according to any of examples Ex53 to Ex61, wherein the step-wise increase of the temperature of the susceptor comprises greater than two temperature steps and less than fourteen temperature steps.

Example Ex63: The aerosol-generating device according to any of examples Ex53 to Ex61, wherein the step-wise increase of the temperature of the susceptor comprises greater than two temperature steps and less than eight temperature steps.

Example Ex64: The aerosol-generating device according to any of examples Ex53 to Ex63, wherein the first operating temperature is sufficient for the aerosol-forming substrate to form an aerosol.

Example Ex65: The aerosol-generating device according to any of examples Ex53 to Ex64, wherein the controller is configured to determine a conductance value or a resistance value associated with the susceptor and to control the power provided to the power supply electronics based on the determined conductance value or the determined resistance value.

Examples Ex66: The aerosol-generating device according to any of examples Ex53 to Ex65, wherein controlling the power provided to the power supply electronics comprises interrupting provision of power provided to the DC/AC converter when the determined conductance value exceeds a preset threshold conductance value and resuming the provision of power to the DC/AC converter when the determined conductance value is below the preset threshold conductance value, or wherein controlling the power provided to the power supply electronics comprises interrupting provision of power provided to the DC/AC converter when the determined resistance value is below a preset threshold resistance value and resuming the provision of power to the DC/AC converter when the determined resistance value is above the preset threshold conductance value.

Examples Ex67: The aerosol-generating device according to any of examples Ex53 to Ex66, wherein the power supply electronics are configured to continually supply power from the power source to the inductor, via the DC/AC converter.

Example Ex68: The aerosol-generating device according to any of examples Ex53 to Ex67, wherein the power supply electronics are configured to supply power from the power source to the inductor, via the DC/AC converter, as a plurality of pulses, each pulse separated by a time interval.

Example Ex69: The aerosol-generating device according to example Ex68, wherein controlling the power provided to the power supply electronics comprises controlling the time interval between each of the plurality of pulses.

Example Ex70: The aerosol-generating device according to example Ex68, wherein controlling the power provided to the power supply electronics comprises controlling the length of each pulse of the plurality of pulses.

Example Ex71: The aerosol-generating device according to any of examples Ex53 to Ex70, wherein the controller is further configured to perform a calibration process for measuring one or more calibration values associated with the susceptor.

Example Ex72: The aerosol-generating device according to example Ex71, wherein controlling the power provided to the power supply electronics comprises controlling the power such that the temperature of the susceptor is adjusted based on the one or more calibration values.

Example: Ex73: The aerosol-generating device according to example Ex71 or Ex72, wherein the one or more calibration values comprise a first conductance value associated with a first calibration temperature of the susceptor and a second conductance value associated with a second calibration temperature of the susceptor.

Example Ex74: The aerosol-generating device according to example Ex71, wherein controlling the power provided to the power supply electronics comprises maintaining a conductance value associated with the susceptor between the first conductance value and the second conductance value.

Example Ex75: The aerosol-generating device according to example Ex71 or Ex72, wherein the one or more calibration values comprise a first resistance value associated with a first calibration temperature of the susceptor and a second resistance value associated with a second calibration temperature of the susceptor.

Example Ex76: The aerosol-generating device according to example Ex75, wherein controlling the power provided to the inductive heating arrangement comprises maintaining a resistance value associated with the susceptor between the first resistance value and the second resistance value.

Example Ex77: The aerosol-generating device according to any of examples Ex73 to Ex76, wherein the second calibration temperature of the susceptor corresponds to a Curie temperature of a material of the susceptor.

Example Ex78. The aerosol-generating device according to any of examples Ex73 to Ex77, wherein controlling the power provided to the power supply electronics comprises controlling the power such that the temperature of the susceptor is between the first calibration temperature and the second calibration temperature.

Example Ex79: The aerosol-generating device according to any of examples Ex73 to Ex78, wherein the first operating temperature is greater than or equal to the first calibration temperature and wherein the second operating temperature is less than or equal to the second calibration temperature.

Examples Ex80: The aerosol-generating device according to any of examples Ex73 to Ex79, wherein the first calibration temperature is between 150 degrees Celsius and 350 degrees Celsius and the second calibration temperature is between 200 degrees Celsius and 400 degrees Celsius, wherein a temperature difference between the first calibration temperature and the second calibration temperature is at least 50 degrees Celsius.

Examples Ex81: The aerosol-generating device according to any of examples Ex71 to Ex80, wherein the calibration process is performed during user operation of the aerosol-generating device for producing an aerosol.

Examples Ex82: The aerosol-generating device according to any of examples Ex71 to Ex81, wherein the calibration process is performed periodically based on one or more of: a predetermined duration of time, a predetermined number of user puffs, a predetermined number of temperature steps, and a measured voltage of the power source.

Example Ex83: The aerosol-generating device according to any of examples Ex71 to Ex82, wherein performing the calibration process comprises the steps of: i) controlling the power provided to the power supply electronics to cause an increase of the temperature of the susceptor; ii) monitoring at least a current value of the power supply electronics; iii) interrupting provision of power to the power supply electronics when the at least the current value reaches a maximum, wherein the current value at the maximum corresponds to the second calibration temperature; and iv) when the current value of the power supply electronics reaches a minimum, controlling the power provided to the power supply electronics to cause an increase of the temperature of the susceptor, wherein the current value at the minimum corresponds to the first calibration temperature.

Example Ex84: The aerosol-generating device according to example Ex83, wherein monitoring the at least a current value of the power supply electronics further comprises monitoring a voltage value of the power supply electronics.

Example Ex85: The aerosol-generating device according to example Ex83 or Ex84, wherein performing the calibration process further comprises repeating steps i) to iv) when the at least the current value associated with the susceptor reaches the minimum.

Example Ex86: The aerosol-generating device according to example Ex85, wherein the controller is further configured to, subsequent to repeating steps i) to iv): store a conductance value corresponding to the current value at the maximum as the second calibration value and store a conductance value corresponding to the current value at the minimum as the first calibration value, or store a resistance value corresponding to the current value at the maximum as the second calibration value and store a resistance value corresponding to the current value at the minimum as the first calibration value.

Example Ex87: The aerosol-generating device according to any of examples Ex71 to Ex82, wherein performing the calibration process comprises the steps of: i) controlling the power provided to the inductive heating arrangement to cause an increase of the temperature of the susceptor; ii) monitoring a conductance value or a resistance value associated with the susceptor; iii) interrupting provision of power to the inductive heating arrangement when the conductance value reaches a maximum or when the resistance value reaches a minimum, wherein the maximum conductance value or the minimum resistance value corresponds to the second calibration temperature of the susceptor; and iv) when the conductance value reaches a minimum or the resistance value reaches a maximum, controlling the power provided to the inductive heating arrangement to cause an increase of the temperature of the susceptor, wherein the minimum conductance value or the maximum resistance value corresponds to the first calibration temperature of the susceptor.

Example Ex88: The aerosol-generating device according to example Ex87, wherein performing the calibration process further comprises repeating steps i) to iv) when the conductance value reaches the minimum or the resistance value reaches the maximum.

Example Ex89: The aerosol-generating device according to example Ex88, wherein the controller is further configured to, subsequent to repeating steps i) to iv), store the conductance value at the maximum or the resistance value at the minimum as the second calibration value and to store the conductance value at the minimum or the resistance value at the maximum as the first calibration value.

Example Ex90: The aerosol-generating device according to any of examples Ex66 to Ex78, wherein the controller is further configured to perform a pre-heating process to heat the susceptor to the first calibration temperature, wherein the pre-heating process has a predetermined duration.

Example Ex91: The aerosol-generating device according to example Ex90, wherein performing the preheating process comprises: controlling the power provided to the power supply electronics to cause an increase of the temperature of the susceptor; monitoring at least a current value of the power supply electronics; and interrupting provision of power to the power supply electronics when the at least the current value reaches the minimum, wherein the conductance value at the minimum corresponds to the first calibration temperature of the susceptor.

Example Ex92: The aerosol-generating device of example Ex91, wherein preforming the pre-heating process further comprises, if the at least the current value reaches a minimum during the predetermined duration of the pre-heating process, interrupting the provision of power to the power supply electronics to cause a decrease of the temperature of the susceptor and subsequently resuming the provision of power to the power supply electronics to cause an increase of the temperature of the susceptor to the first calibration temperature.

Example Ex93: The aerosol-generating device of EX92, wherein interrupting the provision of power to the power supply electronics and the resuming providing power to the power supply electronics is repeated for the predetermined duration of the pre-heating process.

Example Ex94: The aerosol-generating device according to any of EX91 to EX93, wherein the controller is further configured to, if the at least the current value of the susceptor does not reach a minimum during the predetermined duration of the pre-heating process, generate a control signal to cease operation of the aerosol-generating device.

Example Ex95: The aerosol-generating device according to EX90, wherein performing the preheating process comprises: controlling the power provided to the inductive heating arrangement to cause an increase of the temperature of the susceptor; monitoring a conductance value or a resistance value associated with the susceptor; and interrupting provision of power to the inductive heating arrangement when the conductance value reaches a minimum or when the resistance value reaches a maximum, wherein the current value at the minimum or at the resistance value at the maximum corresponds to the first calibration temperature of the susceptor.

Example Ex96: The aerosol-generating device of example Ex95, wherein performing the pre-heating process further comprises, if, during the predetermined duration of the pre-heating process, the conductance value reaches a minimum or the resistance value reaches a maximum, interrupting the provision of power to the inductive heating arrangement to cause a decrease of the temperature of the susceptor and subsequently resuming the provision of power to the inductive heating arrangement to cause an increase of the temperature of the susceptor to the first calibration temperature.

Example Ex97: The aerosol-generating device of example Ex96, wherein interrupting the provision of power to the inductive heating arrangement and the resuming providing power to the inductive heating arrangement is repeated for the predetermined duration of the preheating process.

Example Ex98: The aerosol-generating device according to example Ex95, wherein performing the pre-heating process further comprises: if, during the predetermined duration of the pre-heating process, the conductance value does not reach a minimum or the resistance value does not reach a maximum, ceasing operation of the aerosol-generating device.

Example Ex99: The aerosol-generating device according to any of examples Ex65 to Ex98, further comprising: a current sensor configured to measure, at the input side of the DC/AC converter, a DC current drawn from the power source, wherein the conductance value and the resistance value associated with the susceptor is determined from a DC supply voltage of the power source and from the DC current drawn from the power source.

Example Ex100: The aerosol-generating device according to example Ex99, further comprising a voltage sensor configured to measure, at the input side of the DC/AC converter, the DC supply voltage of the power source.

Example Ex101: The aerosol-generating device according to any of examples Ex53 to Ex100, wherein the first operating temperature is between 150 degrees Celsius and 330 degrees Celsius and the second operating temperature is between 200 degrees Celsius and 400 degrees Celsius, wherein a temperature difference between the first operating temperature and the second operating temperature is at least 30 degrees Celsius.

Example Ex102: The aerosol-generating device according to any of examples Ex53 to Ex101, wherein the step-wise increase of the temperature of the susceptor comprises: a first temperature step having a corresponding to the first operating temperature, wherein the first operating temperature is 330 degrees Celsius, a second temperature step having a temperature of 340 degrees Celsius, a third temperature step having a temperature of 345 degrees Celsius, a fourth temperature step having a temperature of 355 degrees Celsius, and a fifth temperature step having a temperature corresponding to the second operating temperature, wherein the second operating temperature is 380 degrees Celsius.

Example Ex103: The aerosol-generating device according to any of examples Ex53 to Ex102, wherein the power supply electronics further comprise a matching network for matching the impedance of the inductor to that of the susceptor.

Example Ex104: The aerosol-generating device according to any of examples Ex53 to Ex103, further comprising a housing having a cavity configured to removably receive an aerosol-generating article, wherein the aerosol-generating article comprises the aerosol-generating substrate and the susceptor.

Example Ex105: An aerosol-generating system, comprising the aerosol-generating device according to any of examples Ex53 to Ex104 and the aerosol-generating article, wherein the aerosol-generating article comprises the aerosol-generating substrate and the susceptor.

Example Ex106: The aerosol-generating system according to example Ex105, wherein the susceptor comprises a first susceptor material and a second susceptor material, wherein the first susceptor material is disposed in physical contact with the second susceptor material.

Example Ex107: The aerosol-generating system according to example Ex106, wherein the first susceptor material is one of aluminum, iron, and stainless steel, and wherein the second susceptor material is nickel or a nickel alloy.

Example Ex108: The aerosol-generating system according to example Ex106 or Ex107, wherein the first susceptor material has a first Curie temperature and the second susceptor material has a second Curie temperature, wherein the second Curie temperature is lower than the first Curie temperature.

Example Ex109: The aerosol-generating system according to example Ex108, wherein the second calibration temperature corresponds to a Curie temperature of the second susceptor material.

Examples will now be further described with reference to the figures in which.

Figure 1:
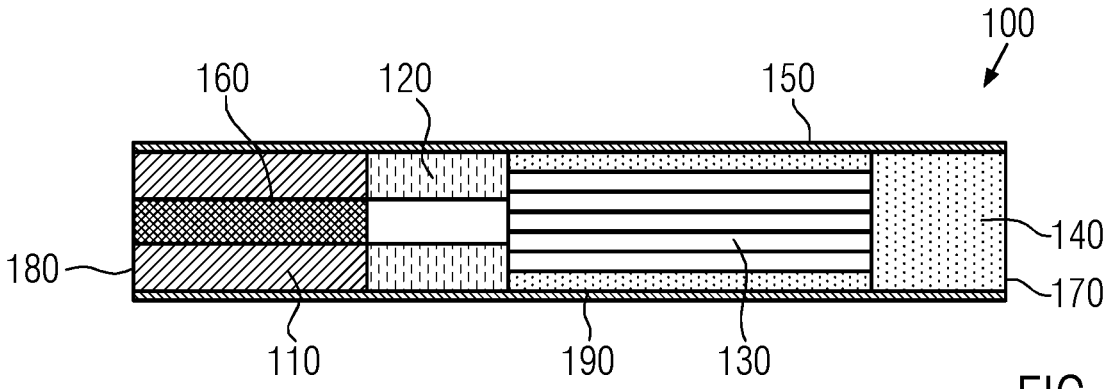
FIG. 1 shows a schematic cross-sectional illustration of an aerosol-generating article.

FIG. 1 illustrates an aerosol-generating article 100. The aerosol-generating article 100 comprises four elements arranged in coaxial alignment: an aerosol-forming substrate 110, a support element 120, an aerosol-cooling element 130, and a mouthpiece 140. Each of these four elements is a substantially cylindrical element, each having substantially the same diameter. These four elements are arranged sequentially and are circumscribed by an outer wrapper 150 to form a cylindrical rod. An elongate susceptor 160 is located within the aerosol-forming substrate 110, in contact with the aerosol-forming substrate 110. The susceptor 160 has a length that is approximately the same as the length of the aerosol-forming substrate 110, and is located along a radially central axis of the aerosol-forming substrate 110.

The susceptor 160 comprises at least two different materials. The susceptor 160 is in the form of an elongate strip, preferably having a length of 12 mm and a width of 4 mm. The susceptor 160 comprises at least two layers: a first layer of a first susceptor material disposed in physical contact with a second layer of a second susceptor material. The first susceptor material and the second susceptor material may each have a Curie temperature. In this case, the Curie temperature of the second susceptor material is lower than the Curie temperature of the first susceptor material. The first material may not have a Curie temperature. The first susceptor material may be aluminum, iron or stainless steel. The second susceptor material may be nickel or a nickel alloy. The susceptor 160 may be formed by electroplating at least one patch of the second susceptor material onto a strip of the first susceptor material. The susceptor may be formed by cladding a strip of the second susceptor material to a strip of the first susceptor material.

The aerosol-generating article 100 has a proximal or mouth end 170, which a user inserts into his or her mouth during use, and a distal end 180 located at the opposite end of the aerosol-generating article 100 to the mouth end 170. Once assembled, the total length of the aerosol-generating article 100 is preferably about 45 mm and the diameter is about 7.2 mm.

In use, air is drawn through the aerosol-generating article 100 by a user from the distal end 180 to the mouth end 170. The distal end 180 of the aerosol-generating article 100 may also be described as the upstream end of the aerosol-generating article 100 and the mouth end 170 of the aerosol-generating article 100 may also be described as the downstream end of the aerosol-generating article 100. Elements of the aerosol-generating article 100 located between the mouth end 170 and the distal end 180 can be described as being upstream of the mouth end 170 or, alternatively, downstream of the distal end 180. The aerosol-forming substrate 110 is located at the distal or upstream end 180 of the aerosol-generating article 100.

The support element 120 is located immediately downstream of the aerosol-forming substrate 110 and abuts the aerosol-forming substrate 110. The support element 120 may be a hollow cellulose acetate tube. The support element 120 locates the aerosol-forming substrate 110 at the extreme distal end 180 of the aerosol-generating article 100. The support element 120 also acts as a spacer to space the aerosol-cooling element 130 of the aerosol-generating article 100 from the aerosol-forming substrate 110.

The aerosol-cooling element 130 is located immediately downstream of the support element 120 and abuts the support element 120. In use, volatile substances released from the aerosol-forming substrate 110 pass along the aerosol-cooling element 130 towards the mouth end 170 of the aerosol-generating article 100. The volatile substances may cool within the aerosol-cooling element 130 to form an aerosol that is inhaled by the user. The aerosol-cooling element 130 may comprise a crimped and gathered sheet of polylactic acid circumscribed by a wrapper 190. The crimped and gathered sheet of polylactic acid defines a plurality of longitudinal channels that extend along the length of the aerosol-cooling element 130.

The mouthpiece 140 is located immediately downstream of the aerosol-cooling element 130 and abuts the aerosol-cooling element 130. The mouthpiece 140 comprises a conventional cellulose acetate tow filter of low filtration efficiency.

To assemble the aerosol-generating article 100, the four elements 110, 120, 130 and 140 described above are aligned and tightly wrapped within the outer wrapper 150. The outer wrapper may be a conventional cigarette paper. The susceptor 160 may be inserted into the aerosol-forming substrate 110 during the process used to form the aerosol-forming substrate 110, prior to the assembly of the plurality of elements, to form a rod.

Figure 2A:
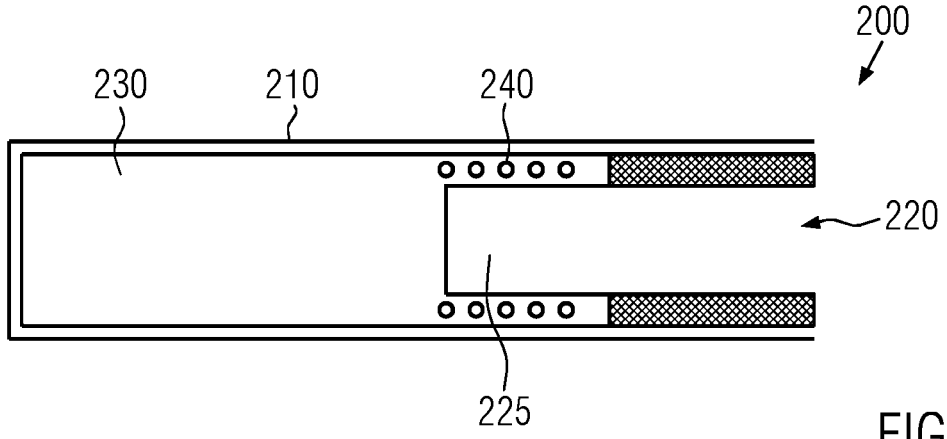
FIG. 2A shows a schematic cross-sectional illustration of an aerosol-generating device for use with the aerosol-generating article illustrated in FIG. 1.
Figure 2B:
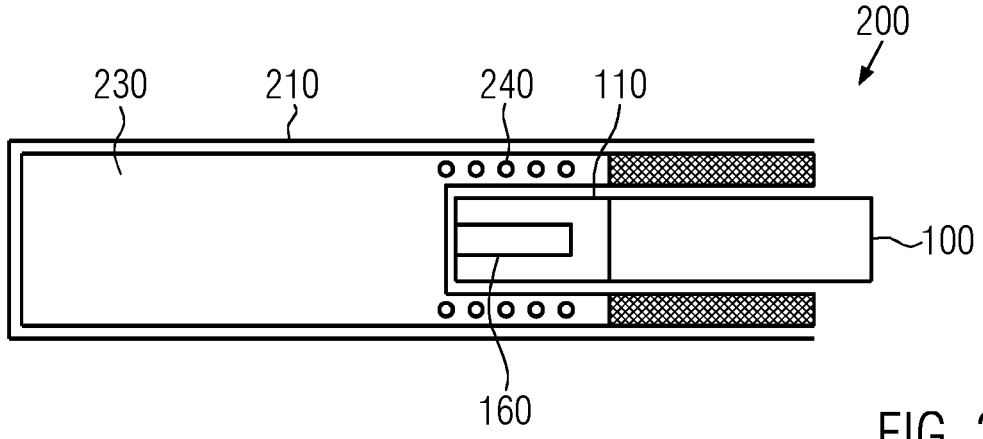
FIG. 2B shows a schematic cross-sectional illustration of the aerosol-generating device in engagement with the aerosol-generating article illustrated in FIG. 1.

The aerosol-generating article 100 illustrated in FIG. 1 is designed to engage with an aerosol-generating device, such as the aerosol-generating device 200 illustrated in FIG. 2A, for producing an aerosol. The aerosol-generating device 200 comprises a housing 210 having a cavity 220 configured to receive the aerosol-generating article 100. The aerosol-generating device 200 further comprises an inductive heating device 230 configured to heat an aerosol-generating article 100 for producing an aerosol. FIG. 2B illustrates the aerosol-generating device 200 when the aerosol-generating article 100 is inserted into the cavity 220.

Figure 3:
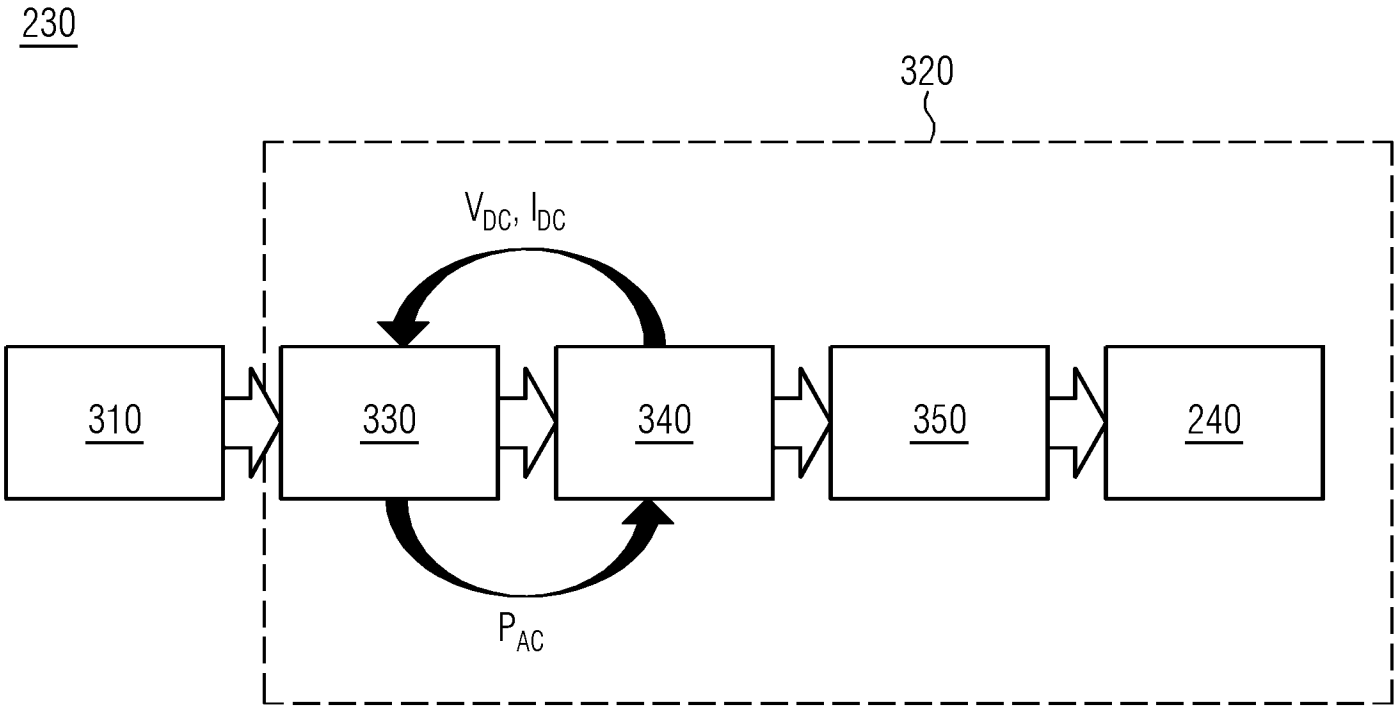
FIG. 3 is a block diagram showing an inductive heating device of the aerosol-generating device described in relation to FIG. 2.

The inductive heating device 230 is illustrated as a block diagram in FIG. 3. The inductive heating device 230 comprises a DC power source 310 and a heating arrangement 320 (also referred to as power supply electronics). The heating arrangement comprises a controller 330, a DC/AC converter 340, a matching network 350 and an inductor 240.

The DC power source 310 is configured to provide DC power to the heating arrangement 320. Specifically, the DC power source 310 is configured to provide a DC supply voltage ($V_{DC}$) and a DC current ($I_{DC}$) to the DC/AC converter 340. Preferably, the power source 310 is a battery, such as a lithium ion battery. As an alternative, the power source 310 may be another form of charge storage device such as a capacitor. The power source 310 may require recharging. For example, the power source 310 may have sufficient capacity to allow for the continuous generation of aerosol for a period of around six minutes or for a period that is a multiple of six minutes. In another example, the power source 310 may have sufficient capacity to allow for a predetermined number of puffs or discrete activations of the heating arrangement.

The DC/AC converter 340 is configured to supply the inductor 240 with a high frequency alternating current. As used herein, the term "high frequency alternating current" means an alternating current having a frequency of between about 500 kilohertz and about 30 megahertz. The high frequency alternating current may have a frequency of between about 1 megahertz and about 30 megahertz, such as between about 1 megahertz and about 10 megahertz, or such as between about 5 megahertz and about 8 megahertz.

Figure 4:
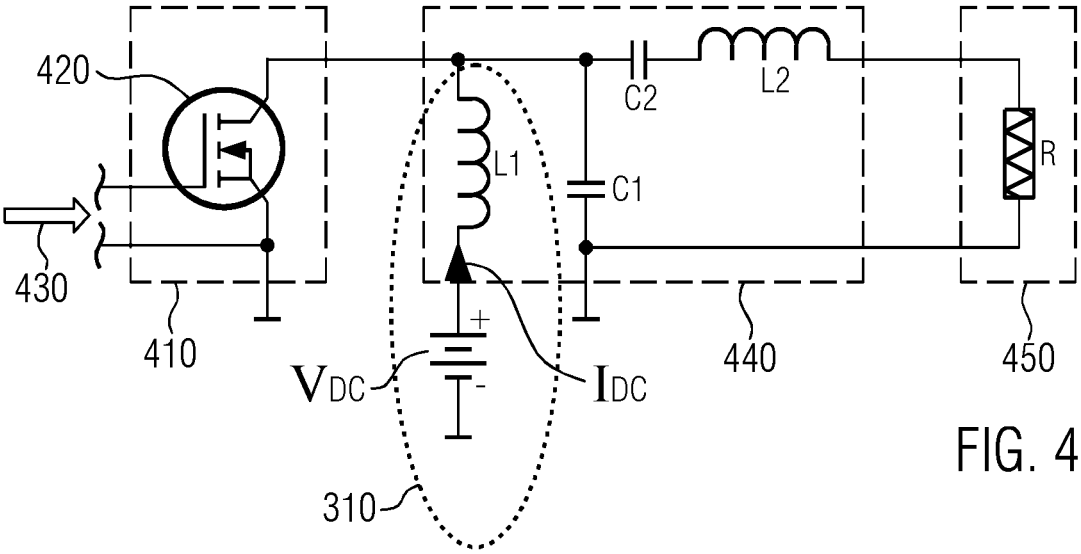
FIG. 4 is a schematic diagram showing electronic components of the inductive heating device described in relation to FIG. 3.
Figure 5:
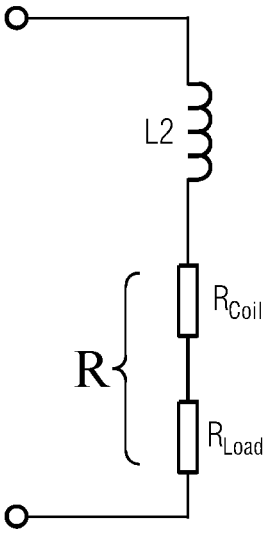
FIG. 5 is a schematic diagram on an inductor of an LC load network of the inductive heating device described in relation to FIG. 4.

FIG. 4 schematically illustrates the electrical components of the inductive heating device 230, in particular the DC/AC converter 340. The DC/AC converter 340 preferably comprises a Class-E power amplifier. The Class-E power amplifier comprises a transistor switch 410 comprising a Field Effect Transistor 420, for example a Metal-Oxide-Semiconductor Field Effect Transistor, a transistor switch supply circuit indicated by the arrow 430 for supplying a switching signal (gate-source voltage) to the Field Effect Transistor 420, and an LC load network 440 comprising a shunt capacitor C1 and a series connection of a capacitor C2 and inductor L2, corresponding to inductor 240. In addition, the DC power source 310, comprising a choke L1, is shown for supplying the DC supply voltage $V_{DC}$, with a DC current $I_{DC}$ being drawn from the DC power source 310 during operation. The ohmic resistance R representing the total ohmic load 450, which is the sum of the ohmic resistance $R_{coil}$ of the inductor L2 and the ohmic resistance $R_{load}$ of the susceptor 160, is shown in more detail in FIG. 5.

Although the DC/AC converter 340 is illustrated as comprising a Class-E power amplifier, it is to be understood that the DC/AC converter 340 may use any suitable circuitry that converts DC current to AC current. For example, the DC/AC converter 340 may comprise a class-D power amplifier comprising two transistor switches. As another example, the DC/AC converter 340 may comprise a full bridge power inverter with four switching transistors acting in pairs.

Turning back to FIG. 3, the inductor 240 may receive the alternating current from the DC/AC converter 340 via a matching network 350 for optimum adaptation to the load, but the matching network 350 is not essential. The matching network 350 may comprise a small matching transformer. The matching network 350 may improve power transfer efficiency between the DC/AC converter 340 and the inductor 240.

As illustrated in FIG. 2A, the inductor 240 is located adjacent to the distal portion 225 of the cavity 220 of the aerosol-generating device 200. Accordingly, the high frequency alternating current supplied to the inductor 240 during operation of the aerosol-generating device 200 causes the inductor 240 to generate a high frequency alternating magnetic field within the distal portion 225 of the aerosol-generating device 200. The alternating magnetic field preferably has a frequency of between 1 and 30 megahertz, preferably between 2 and 10 megahertz, for example between 5 and 7 megahertz. As can be seen from FIG. 2B, when an aerosol-generating article 100 is inserted into the cavity 200, the aerosol-forming substrate 110 of the aerosol-generating article 100 is located adjacent to the inductor 240 so that the susceptor 160 of the aerosol-generating article 100 is located within this alternating magnetic field. When the alternating magnetic field penetrates the susceptor 160, the alternating magnetic field causes heating of the susceptor 160. For example, eddy currents are generated in the susceptor 160 which is heated as a result. Further heating is provided by magnetic hysteresis losses within the susceptor 160. The heated susceptor 160 heats the aerosol-forming substrate 110 of the aerosol-generating article 100 to a sufficient temperature to form an aerosol. The aerosol is drawn downstream through the aerosol-generating article 100 and inhaled by the user.

The controller 330 may be a microcontroller, preferably a programmable microcontroller. The controller 330 is programmed to regulate the supply of power from the DC power source 310 to the inductive heating arrangement 320 in order to control the temperature of the susceptor 160.

Figure 6:
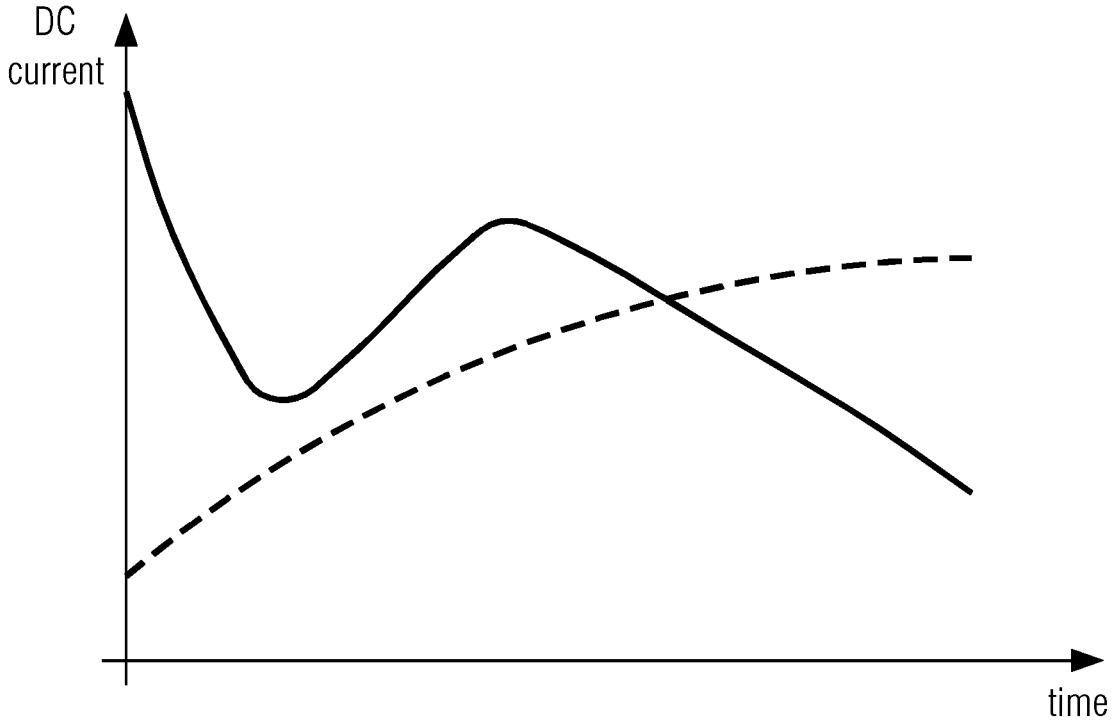
FIG. 6 is a graph of DC current vs. time illustrating the remotely detectable current changes that occur when a susceptor material undergoes a phase transition associated with its Curie point.

FIG. 6 illustrates the relationship between the DC current $I_{DC}$ drawn from the power source 310 over time as the temperature of the susceptor 160 (indicated by the dashed line) increases. The DC current $I_{DC}$ drawn from the power source 310 is measured at an input side of the DC/AC converter 340. For the purpose of this illustration, it may be assumed that the voltage $V_{DC}$ of the power source 310 remains approximately constant. As the susceptor 160 is inductively heated, the apparent resistance of the susceptor 160 increases. This increase in resistance is observed as a decrease in the DC current $I_{DC}$ drawn from the power source 310, which at constant voltage decreases as the temperature of the susceptor 160 increases. The high frequency alternating magnetic field provided by the inductor 240 induces eddy currents in close proximity to the susceptor surface, an effect that is known as the skin effect. The resistance in the susceptor 160 depends in part on the electrical resistivity of the first susceptor material, the resistivity of the second susceptor material and in part on the depth of the skin layer in each material available for induced eddy currents, and the resistivity is in turn temperature dependent. As the second susceptor material reaches its Curie temperature, it loses its magnetic properties. This causes an increase in the skin layer available for eddy currents in the second susceptor material, which causes a decrease in the apparent resistance of the susceptor 160. The result is a temporary increase in the detected DC current $I_{DC}$ when the skin depth of the second susceptor material begins to increase, the resistance begins to fall. This is seen as the valley (the local minimum) in FIG. 6. The current continues to increase until the maximum skin depth is reached, which coincides with the point where the second susceptor material has lost its spontaneous magnetic properties. This point is called the Curie temperature and is seen as the hill (the local maximum) in FIG. 6. At this point the second susceptor material has undergone a phase change from a ferro-magnetic or ferri-magnetic state to a paramagnetic state. At this point, the susceptor 160 is at a known temperature (the Curie temperature, which is an intrinsic material-specific temperature). If the inductor 240 continues to generate an alternating magnetic field (i.e. power to the DC/AC converter 340 is not interrupted) after the Curie temperature has been reached, the eddy currents generated in the susceptor 160 will run against the resistance of the susceptor 160, whereby Joule heating in the susceptor 160 will continue, and thereby the resistance will increase again (the resistance will have a polynomial dependence of the temperature, which for most metallic susceptor materials can be approximated to a third degree polynomial dependence for our purposes) and current will start falling again as long as the inductor 240 continues to provide power to the susceptor 160.

Therefore, as can be seen from FIG. 6, the apparent resistance of the susceptor 160 (and correspondingly the current $I_{DC}$ drawn from the power source 310) may vary with the temperature of the susceptor 160 in a strictly monotonic relationship over certain ranges of temperature of the susceptor 160. The strictly monotonic relationship allows for an unambiguous determination of the temperature of the susceptor 160 from a determination of the apparent resistance or apparent conductance (1/R). This is because each determined value of the apparent resistance is representative of only one single value of the temperature, so that there is no ambiguity in the relationship. The monotonic relationship of the temperature of the susceptor 160 and the apparent resistance allows for the determination and control of the temperature of the susceptor 160 and thus for the determination and control of the temperature of the aerosol-forming substrate 110. The apparent resistance of the susceptor 160 can be remotely detected by monitoring at least the DC current $I_{DC}$ drawn from the DC power source 310.

At least the DC current $I_{DC}$ drawn from the power source 310 is monitored by the controller 330. Preferably, both the DC current $I_{DC}$ drawn from the power source 310 and the DC supply voltage $V_{DC}$ are monitored. The controller 330 regulates the supply of power provided to the heating arrangement 320 based on a conductance value or a resistance value, where conductance is defined as the ratio of the DC current $I_{DC}$ to the DC supply voltage $V_{DC}$ and resistance is defined as the ratio of the DC supply voltage $V_{DC}$ to the DC current $I_{DC}$. The heating arrangement 320 may comprise a current sensor (not shown) to measure the DC current $I_{DC}$. The heating arrangement may optionally comprise a voltage sensor (not shown) to measure the DC supply voltage $V_{DC}$. The current sensor and the voltage sensor are located at an input side of the DC/AC converter 340. The DC current $I_{DC}$ and optionally the DC supply voltage $V_{DC}$ are provided by feedback channels to the controller 330 to control the further supply of AC power $P_{AC}$ to the inductor 240.

The controller 330 may control the temperature of the susceptor 160 by maintaining the measured conductance value or the measured resistance value at a target value corresponding to a target operating temperature of the susceptor 160. The controller 330 may use any suitable control loop to maintain the measured conductance value or the measured resistance value at the target value, for example by using a proportional-integral-derivative control loop.

In order to take advantage of the strictly monotonic relationship between the apparent resistance (or apparent conductance) of the susceptor 160 and the temperature of the susceptor 160, during user operation for producing an aerosol, the conductance value or the resistance value associated with the susceptor and measured at the input side of the DC/AC converter 340 is maintained between a first calibration value corresponding to a first calibration temperature and a second calibration value corresponding to a second calibration temperature. The second calibration temperature is the Curie temperature of the second susceptor material (the hill in the current plot in FIG. 6). The first calibration temperature is a temperature greater than or equal to the temperature of the susceptor at which the skin depth of the second susceptor material begins to increase (leading to a temporary lowering of the resistance). Thus, the first calibration temperature is a temperature greater than or equal to the temperature at maximum permeability of the second susceptor material. The first calibration temperature is at least 50 degrees Celsius lower than the second calibration temperature. At least the second calibration value may be determined by calibration of the susceptor 160, as will be described in more detail below. The first calibration value and the second calibration value may be stored as calibration values in a memory of the controller 330.

Since the conductance (resistance) will have a polynomial dependence on the temperature, the conductance (resistance) will behave in a nonlinear manner as a function of temperature. However, the first and second calibration values are chosen so that this dependence may be approximated as being linear between the first calibration value and the second calibration value because the difference between the first and the second calibration values is small, and the first and the second calibration values are in the upper part of the operational temperature range. Therefore, to adjust the temperature to a target operating temperature, the conductance is regulated according to the first calibration value and the second calibration value, through linear equations. For example, if the first and the second calibration values are conductance values, the target conductance value corresponding to the target operating temperature may be given by:

$$G_{Target}=G_{Lower}+(x\times\Delta G)$$

where ΔG is the difference between the first conductance value and the second conductance value and x is a percentage of ΔG.

The controller 330 may control the provision of power to the heating arrangement 320 by adjusting the duty cycle of the switching transistor 410 of the DC/AC converter 340. For example, during heating, the DC/AC converter 340 continuously generates alternating current that heats the susceptor 160, and simultaneously the DC supply voltage $V_{DC}$ and the DC current $I_{DC}$ may be measured, preferably every millisecond for a period of 100 milliseconds. If the conductance is monitored by the controller 330, when the conductance reaches or exceeds a value corresponding to the target operating temperature, the duty cycle of the switching transistor 410 is reduced. If the resistance is monitored by the controller 330, when the resistance reaches or goes below a value corresponding to the target operating temperature, the duty cycle of the switching transistor 410 is reduced. For example, the duty cycle of the switching transistor 410 may be reduced to about 9%. In other words, the switching transistor 410 may be switched to a mode in which it generates pulses only every 10 milliseconds for a duration of 1 millisecond. During this 1 millisecond on-state (conductive state) of the switching transistor 410, the values of the DC supply voltage $V_{DC}$ and of the DC current $I_{DC}$ are measured and the conductance is determined. As the conductance decreases (or the resistance increases) to indicate that the temperature of the susceptor 160 is below the target operating temperature, the gate of the transistor 410 is again supplied with the train of pulses at the chosen drive frequency for the system.

The power may be supplied by the controller 330 to the inductor 240 in the form of a series of successive pulses of electrical current. In particular, power may be supplied to the inductor 240 in a series of pulses, each separated by a time interval. The series of successive pulses may comprise two or more heating pulses and one or more probing pulses between successive heating pulses. The heating pulses have an intensity such as to heat the susceptor 160. The probing pulses are isolated power pulses having an intensity such not to heat the susceptor 160 but rather to obtain a feedback on the conductance value or resistance value and then on the evolution (decreasing) of the susceptor temperature. The controller 330 may control the power by controlling the duration of the time interval between successive heating pulses of power supplied by the DC power supply to the inductor 240. Additionally or alternatively, the controller 330 may control the power by controlling the length (in other words, the duration) of each of the successive heating pulses of power supplied by the DC power supply to the inductor 240.

The controller 330 is programmed to perform a calibration process in order to obtain the calibration values at which the conductance is measured at known temperatures of the susceptor 160. The known temperatures of the susceptor may be the first calibration temperature corresponding to the first calibration value and the second calibration temperature corresponding to the second calibration value. Preferably, the calibration process is performed each time the user operates the aerosol-generating device 200, for example each time the user inserts an aerosol-generating article 100 into an aerosol-generating device 200.

During the calibration process, the controller 330 controls the DC/AC converter 340 to continuously or continually supply power to the inductor 240 in order to heat the susceptor 160. The controller 330 monitors the conductance or resistance associated with the susceptor 160 by measuring the current $I_{DC}$ drawn by the power supply and, optionally the power supply voltage $V_{DC}$. As discussed above in relation to FIG. 6, as the susceptor 160 is heated, the measured current decreases until a first turning point is reached and the current begins to increase. This first turning point corresponds to a local minimum conductance value (a local maximum resistance value). The controller 330 may record the local minimum value of conductance (or local maximum of resistance) as the first calibration value. The controller may record the value of conductance or resistance at a predetermined time after the minimum current has been reached as the first calibration value. The conductance or resistance may be determined based on the measured current $I_{DC}$ and the measured voltage $V_{DC}$. Alternatively, it may be assumed that the power supply voltage $V_{DC}$, which is a known property of the power source 310, is approximately constant. The temperature of the susceptor 160 at the first calibration value is referred to as the first calibration temperature. Preferably, the first calibration temperature is between 150 degrees Celsius and 350 degrees Celsius. More preferably, when the aerosol-forming substrate 110 comprises tobacco, the first calibration temperature is 320 degrees Celsius. The first calibration temperature is at least 50 degrees Celsius lower than the second calibration temperature.

As the controller 330 continues to control the power provided by the DC/AC converter 340 to the inductor 240, the measured current increases until a second turning point is reached and a maximum current is observed (corresponding to the Curie temperature of the second susceptor material) before the measured current begins to decrease. This turning point corresponds to a local maximum conductance value (a local minimum resistance value). The controller 330 records the local maximum value of the conductance (or local minimum of resistance) as the second calibration value. The temperature of the susceptor 160 at the second calibration value is referred to as the second calibration temperature. Preferably, the second calibration temperature is between 200 degrees Celsius and 400 degrees Celsius. When the maximum is detected, the controller 330 controls the DC/AC converter 340 to interrupt provision of power to the inductor 240, resulting in a decrease in susceptor 160 temperature and a corresponding decrease in conductance.

Due to the shape of the graph, this process of continuously heating the susceptor 160 to obtain the first calibration value and the second calibration value may be repeated at least once. After interrupting provision of power to the inductor 240, the controller 330 continues to monitor the conductance (or resistance) until a third turning point corresponding to a second minimum conductance value (a second maximum resistance value) is observed. When the third turning point is detected, the controller 330 controls the DC/AC converter 340 to continuously provide power to the inductor 240 until a fourth turning point corresponding to a second maximum conductance value (second minimum resistance value) is detected. The controller 330 stores the conductance value or the resistance value at or just after the third turning point as the first calibration value and the conductance value or the resistance value at the fourth turning point current as the second calibration value. The repetition of the measurement of the turning points corresponding to minimum and maximum measured current significantly improves the subsequent temperature regulation during user operation of the device for producing an aerosol. Preferably, controller 330 regulates the power based on the conductance or resistance values obtained from the second maximum and the second minimum, this being more reliable because the heat will have had more time to distribute within the aerosol-forming substrate 110 and the susceptor 160.

In order to further improve the reliability of the calibration process, the controller 310 may be optionally programmed to perform a pre-heating process before the calibration process. For example, if the aerosol-forming substrate 110 is particularly dry or in similar conditions, the calibration may be performed before heat has spread within the aerosol-forming substrate 110, reducing the reliability of the calibration values. If the aerosol-forming substrate 110 were humid, the susceptor 160 takes more time to reach the valley temperature (due to water content in the substrate 110).

To perform the pre-heating process, the controller 330 is configured to continuously provide power to the inductor 240. As described above, the current starts decreasing with increasing susceptor 160 temperature until the minimum is reached. At this stage, the controller 330 is configured to wait for a predetermined period of time to allow the susceptor 160 to cool before continuing heating. The controller 330 therefore controls the DC/AC converter 340 to interrupt provision of power to the inductor 240. After the predetermined period of time, the controller 330 controls the DC/AC converter 340 to provide power until the minimum is reached. At this point, the controller controls the DC/AC converter 340 to interrupt provision of power to the inductor 240 again. The controller 330 again waits for the same predetermined period of time to allow the susceptor 160 to cool before continuing heating. This heating and cooling of the susceptor 160 is repeated for the predetermined duration of time of the pre-heating process. The predetermined duration of the pre-heating process is preferably 11 seconds. The predetermined combined durations of the pre-heating process followed by the calibration process is preferably 20 seconds.

If the aerosol-forming substrate 110 is dry, the first minimum of the pre-heating process is reached within the pre-determined period of time and the interruption of power will be repeated until the end of the predetermined time period. If the aerosol-forming substrate 110 is humid, the first minimum of the pre-heating process will be reached towards the end of the pre-determined time period. Therefore, performing the pre-heating process for a predetermined duration ensures that, whatever the physical condition of the substrate 110, the time is sufficient for the substrate 110 to reach the minimum temperature, in order to be ready to feed continuous power and reach the first maximum. This allows a calibration as early as possible, but still without risking that the substrate 110 would not have reached the valley beforehand.

Further, the aerosol-generating article 100 may be configured such that the minimum is always reached within the predetermined duration of the pre-heating process. If the minimum is not reached within the pre-determined duration of the pre-heating process, this may indicate that the aerosol-generating article 100 comprising the aerosol-forming substrate 110 is not suitable for use with the aerosol-generating device 200. For example, the aerosol-generating article 100 may comprise a different or lower-quality aerosol-forming substrate 110 than the aerosol-forming substrate 100 intended for use with the aerosol-generating device 200. As another example, the aerosol-generating article 100 may not be configured for use with the heating arrangement 320, for example if the aerosol-generating article 100 and the aerosol-generating device 200 are manufactured by different manufacturers. Thus, the controller 330 may be configured to generate a control signal to cease operation of the aerosol-generating device 200.

The pre-heating process may be performed in response to receiving a user input, for example user activation of the aerosol-generating device 200. Additionally or alternatively, the controller 330 may be configured to detect the presence of an aerosol-generating article 100 in the aerosol-generating device 200 and the pre-heating process may be performed in response to detecting the presence of the aerosol-generating article 100 within the cavity 220 of the aerosol-generating device 200.

Figure 7:
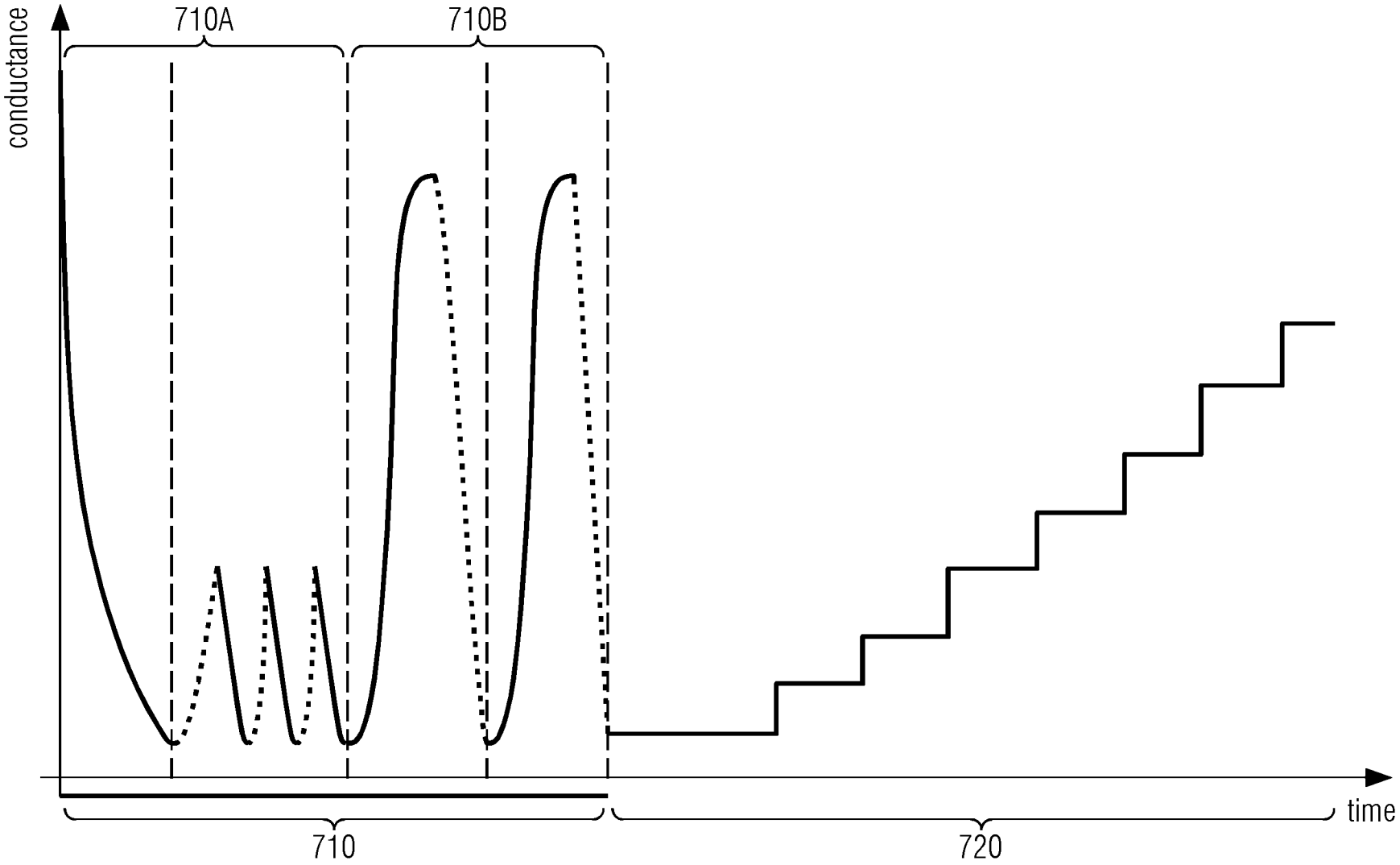
FIG. 7 illustrates a temperature profile of the susceptor during operation of the aerosol-generating device.

FIG. 7 is a graph of conductance against time showing a heating profile of the susceptor 160. The graph illustrates two consecutive phases of heating: a first heating phase 710 comprising the pre-heating process 710A and the calibration process 710B described above, and a second heating phase 720 corresponding to user operation of the aerosol-generating device 200 to produce an aerosol. Although FIG. 7 is illustrated as a graph of conductance against time, it is to be understood that the controller 330 may be configured to control the heating of the susceptor during the first heating phase 710 and the second heating phase 720 based on measured resistance or current as described above.

Further, although the techniques to control of the heating of the susceptor during the first heating phase 710 and the second heating phase 720 have been described above based on a determined conductance value or a determined resistance value associated with the susceptor, it is to be understood that the techniques described above could be performed based on a value of current measured at the input of the DC/AC converter 340.

As can be seen from FIG. 7, the second heating phase 720 comprises a plurality of conductance steps, corresponding to a plurality of temperature steps from a first operating temperature of the susceptor 160 to a second operating temperature of the susceptor 160. The first operating temperature of the susceptor is a minimum temperature at which the aerosol-forming substrate will form an aerosol in a sufficient volume and quantity for a satisfactory experience when inhaled a user. The second operating temperature of the susceptor is the temperature at maximum temperature at which it is desirable for the aerosol-forming substrate to be heated for the user to inhale the aerosol. The first operating temperature of the susceptor 160 is greater than or equal to the first calibration temperature of the susceptor 160 at the valley of the current plot shown in FIG. 6. The first operating temperature may be between 150 degrees Celsius and 330 degrees Celsius. The second operating temperature of the susceptor is less than or equal to the second calibration temperature of the susceptor 160 at the Curie temperature of the second susceptor material. The second operating temperature may be between 200 degrees Celsius and 400 degrees Celsius. The difference between the first operating temperature and the second operating temperature is at least 50 degree Celsius. The first operating temperature of the susceptor is a temperature at which the aerosol-forming substrate 110 forms an aerosol so that an aerosol is formed during each temperature step.

It is to be understood that the number of temperature steps illustrated in FIG. 7 is exemplary and that second heating phase 720 comprises at least three consecutive temperature steps, preferably between two and fourteen temperature steps, most preferably between three and eight temperature steps. Each temperature step may have a predetermined duration. Preferably the duration of the first temperature step is longer than the duration of subsequent temperature steps. The duration of each temperature step is preferably longer than 10 seconds, preferably between 30 seconds and 200 seconds, more preferably between 40 seconds and 160 seconds. The duration of each temperature step may correspond to a predetermined number of user puffs. Preferably, the first temperature step corresponds to four user puffs and each subsequent temperature step corresponds to one user puff.

For the duration of each temperature step, the temperature of the susceptor 160 is maintained at a target operating temperature corresponding to the respective temperature step. Thus, for the duration of each temperature step, the controller 330 controls the provision of power to the heating arrangement 320 such that the conductance is maintained at a value corresponding to the target operating temperature of the respective temperature step as described above. Target conductance values for each temperature step may be stored in the memory of the controller 330.

Figure 8:
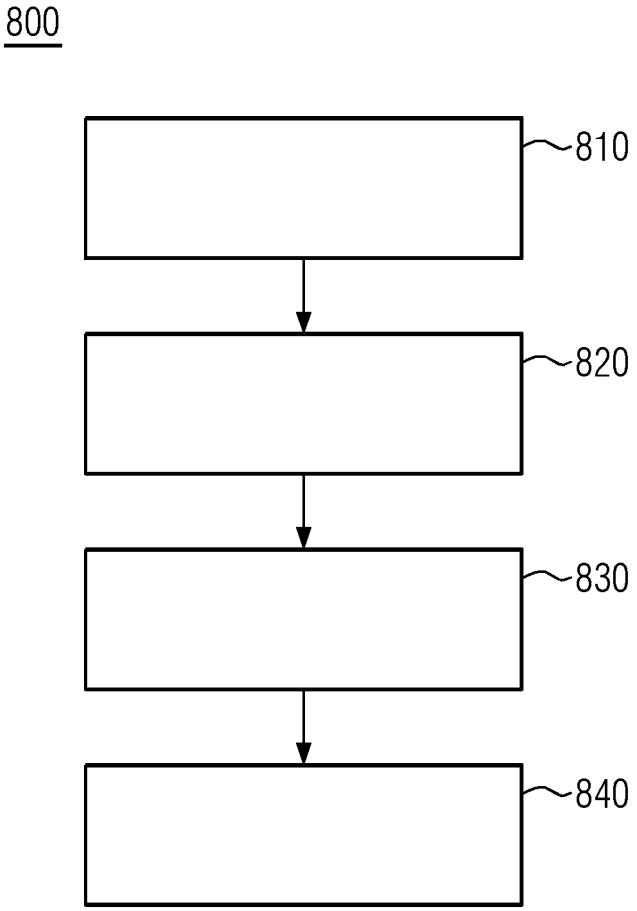
FIG. 8 is a flow diagram showing a method for controlling aerosol-production in the aerosol-generating device of FIG. 2.

As an example, the second heating phase 720 may comprise five temperature steps: a first temperature step having a duration of 160 seconds and a target conductance value of $G_{Target}=G_{Lower}+(0.09\times\Delta G)$, a second temperature step having a duration of 40 seconds and a target conductance value of $G_{Target}=G_{Lower}+(0.25\times\Delta G)$, a third temperature step having a duration of 40 seconds and a target conductance value of $G_{Target}=G_{Lower}+(0.4\times\Delta G)$, a fourth temperature step having a duration of 40 seconds and a target conductance value of $G_{Target}=G_{Lower}+(0.56\times\Delta G)$ and a fifth temperature step having a duration of 85 seconds and a target conductance value of $G_{Target}=G_{Lower}+(0.75\times\Delta G)$. These temperature steps may correspond to temperatures of 330 degrees Celsius, 340 degrees Celsius, 345 degrees Celsius, 355 degrees Celsius and 380 degrees Celsius. FIG. 8 is a flow diagram of a method 800 for controlling aerosol-production in an aerosol-generating device 200. As described above, the controller 330 may be programmed to perform the method 800.

The method begins at step 810, where the controller 330 detects user operation of the aerosol-generating device 200 for producing an aerosol. Detecting user operation of the aerosol-generating device 200 may comprise detecting a user input, for example user activation of the aerosol-generating device 200. Additionally or alternatively, detecting user operation of the aerosol-generating device 200 may comprise detecting that an aerosol-generating article 100 has been inserted into the aerosol-generating device 200.

In response to detecting the user operation at step 810, the controller 330 may be configured to perform the optional pre-heating process described above. At the end of the predetermined duration of the pre-heating process, the controller 330 performs the calibration process (step 820) as described above. Alternatively, the controller 330 may be configured to proceed to step 820 in response to detecting the user operation at step 810. Following completion of the calibration process, the controller 330 performs the second heating phase in which the aerosol is produced at step 840.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A method for controlling aerosol production in an aerosol-generating device, the aerosol-generating device comprising an inductive heating arrangement and a power source configured to provide power to the inductive heating arrangement, the method comprising:

controlling the power provided to the inductive heating arrangement to cause a step-wise increase of a temperature of a susceptor associated with the aerosol-generating device from a first operating temperature to a second operating temperature, wherein the step-wise increase of the temperature of the susceptor comprises at least three consecutive temperature steps, each temperature step having a duration, wherein the duration corresponds to a predetermined number of user puffs, wherein the susceptor is configured to heat an aerosol-forming substrate, wherein the power is controlled based on a measured resistance, conductance, or current associated with the susceptor, and wherein the measured resistance, conductance, or current associated with the susceptor is determined based on a DC current drawn from the power source.

2. The method according to claim 1, wherein the duration is at least 10 seconds.

3. The method according to claim 1, wherein the first operating temperature is sufficient for the aerosol-forming substrate to form an aerosol.

4. The method according to claim 1, further comprising performing a calibration process for measuring one or more calibration values associated with the susceptor.

5. The method according to claim 4, wherein controlling the power provided to the inductive heating arrangement comprises controlling the power such that the temperature of the susceptor is adjusted based on the one or more calibration values.

6. The method according to claim 4, wherein the one or more calibration values comprise a first conductance value associated with a first calibration temperature of the susceptor and a second conductance value associated with a second calibration temperature of the susceptor, or wherein the one or more calibration values comprise a first resistance value associated with a first calibration temperature of the susceptor and a second resistance value associated with a second calibration temperature of the susceptor.

7. The method according to claim 6, wherein the susceptor comprises a first susceptor material having a first Curie temperature and a second susceptor material having a second Curie temperature, wherein the second Curie temperature is lower than the first Curie temperature, and wherein the second calibration temperature corresponds to the second Curie temperature of the second susceptor material.

8. The method according to claim 6, wherein controlling the power provided to the inductive heating arrangement comprises controlling the power such that the temperature of the susceptor is between the first calibration temperature and the second calibration temperature.

9. The method according to claim 4, wherein the calibration process is performed during user operation of the aerosol-generating device for producing an aerosol.

10. The method according to claim 6, further comprising performing a pre-heating process to heat the susceptor to the first calibration temperature, wherein the pre-heating process has a predetermined duration.

11. The method according to claim 1, wherein the susceptor and the aerosol-forming substrate form part of an aerosol-generating article, and wherein the aerosol-generating device is configured to removably receive the aerosol-generating article.

12. An aerosol-generating device, comprising:

a power source configured to provide a DC supply voltage and a DC current; and power supply electronics connected to the power source, wherein the power supply electronics comprise:

a DC/AC converter, an inductor connected to the DC/AC converter and being configured to generate an alternating magnetic field when energized by an alternating current from the DC/AC converter, the inductor being couplable to a susceptor, wherein the susceptor is configured to heat an aerosol-forming substrate, and a controller configured to control power provided to the power supply electronics to cause a step-wise increase of a temperature of the susceptor from a first operating temperature to a second operating temperature, wherein the step-wise increase of the temperature of the susceptor comprises at least three consecutive temperature steps, each temperature step having a duration, wherein the duration corresponds to a predetermined number of user puffs, wherein the power is controlled based on a measured resistance, conductance, or current associated with the susceptor, and wherein the measured resistance, conductance, or current associated with the susceptor is determined based on a DC current drawn from the power source.

13. The aerosol-generating device according to claim 12, wherein, for the duration of each temperature step, the controller is further configured to control the power provided to the power supply electronics to maintain the temperature of the susceptor at a predetermined temperature.

14. The aerosol-generating device according to claim 12, wherein the controller is further configured to perform a calibration process for measuring one or more calibration values associated with the susceptor.

15. The aerosol-generating device according to claim 14, wherein the one or more calibration values comprise a first conductance value associated with a first calibration temperature of the susceptor and a second conductance value associated with a second calibration temperature of the susceptor, or wherein the one or more calibration values comprise a first resistance value associated with a first calibration temperature of the susceptor and a second resistance value associated with a second calibration temperature of the susceptor.

16. The aerosol-generating device according to claim 14, further comprising a current sensor configured to measure, at an input side of the DC/AC converter, a DC current drawn from the power source, wherein a conductance value and a resistance value associated with the susceptor are determined from a DC supply voltage of the power source and from the DC current drawn from the power source.

17. The aerosol-generating device according to claim 16, further comprising a voltage sensor configured to measure, at the input side of the DC/AC converter, the DC supply voltage of the power source.

18. An aerosol-generating system, comprising the aerosol-generating device according to claim 12 and an aerosol-generating article, wherein the aerosol-generating article comprises the aerosol-generating substrate and the susceptor.

* * * * *